US012467704B2

(12) United States Patent
Hafen

(10) Patent No.: US 12,467,704 B2
(45) Date of Patent: Nov. 11, 2025

(54) SMART-GUN ARTIFICIAL INTELLIGENCE SYSTEMS AND METHODS

(71) Applicant: John Hafen, Woodinville, WA (US)

(72) Inventor: John Hafen, Woodinville, WA (US)

( * ) Notice: Subject to any disclaimer, the term of this patent is extended or adjusted under 35 U.S.C. 154(b) by 117 days.

(21) Appl. No.: 18/439,451

(22) Filed: Feb. 12, 2024

(65) Prior Publication Data

US 2024/0183632 A1 Jun. 6, 2024

Related U.S. Application Data

(63) Continuation-in-part of application No. 17/200,072, filed on Mar. 12, 2021, now abandoned, which is a continuation of application No. 16/274,791, filed on Feb. 13, 2019, now Pat. No. 10,976,122, which is a continuation of application No. 15/430,354, filed on Feb. 10, 2017, now Pat. No. 10,260,830.

(60) Provisional application No. 62/294,171, filed on Feb. 11, 2016.

(51) Int. Cl.
*F41A 17/06* (2006.01)
*F41A 17/64* (2006.01)

(52) U.S. Cl.
CPC ..... *F41A 17/063* (2013.01); *F41A 17/64* (2013.01)

(58) Field of Classification Search
None
See application file for complete search history.

(56) References Cited

U.S. PATENT DOCUMENTS

| | | | |
|---|---|---|---|
| 5,448,847 | A | 9/1995 | Teetzel |
| 5,570,528 | A | 11/1996 | Teetzel |
| 6,223,461 | B1 | 5/2001 | Mardirossian |
| 6,735,897 | B1 | 5/2004 | Schmitter et al. |
| 7,600,339 | B2 | 10/2009 | Schumacher et al. |
| 8,166,693 | B2 | 5/2012 | Hughes et al. |
| 9,115,944 | B2 | 8/2015 | Arif et al. |
| 9,189,155 | B2 | 11/2015 | Kushler et al. |
| 9,222,740 | B1 | 12/2015 | Milde, Jr. et al. |
| 9,316,454 | B2 | 4/2016 | Milde, Jr. |
| 10,260,830 | B2 | 4/2019 | Hafen |
| 10,365,057 | B2 | 7/2019 | Black et al. |
| 2003/0229499 | A1 | 12/2003 | Von Bosse et al. |
| 2014/0215883 | A1 | 8/2014 | Milde, Jr. |
| 2014/0250753 | A1 | 9/2014 | Karmanov Kotliarov et al. |

(Continued)

FOREIGN PATENT DOCUMENTS

| | | | |
|---|---|---|---|
| CA | 2299307 | A1 | 11/1999 |
| CN | 1190921 | A | 8/1998 |

(Continued)

*Primary Examiner* — Reginald S Tillman, Jr.
(74) *Attorney, Agent, or Firm* — Davis Wright Tremaine LLP

(57) ABSTRACT

A computer-implemented method of a smart-gun system that includes obtaining a set of smart-gun data, determining one or more states of a smart-gun based at least in part on the set of smart-gun data, determining one or more states of a user based at least in part on the set of smart-gun data, determining to generate a conversation statement based at least in part on the one or more states of the smart-gun and the one or more states of the user, and presenting a conversation statement generated based at least in part on the one or more states of the smart-gun and the one or more states of the user.

17 Claims, 9 Drawing Sheets

(56) References Cited

U.S. PATENT DOCUMENTS

| | | | |
|---|---|---|---|
| 2014/0259841 | A1 | 9/2014 | Carlson |
| 2014/0290109 | A1 | 10/2014 | Stewart et al. |
| 2014/0290110 | A1 | 10/2014 | Stewart et al. |
| 2014/0360073 | A1 | 12/2014 | Stewart et al. |
| 2014/0366420 | A1 | 12/2014 | Hager |
| 2015/0068093 | A1 | 3/2015 | Milde, Jr. et al. |
| 2015/0184962 | A1 | 7/2015 | Burdine |
| 2015/0199547 | A1 | 7/2015 | Fraccaroli |
| 2015/0286373 | A1 | 10/2015 | Chukwu |
| 2017/0010062 | A1 | 1/2017 | Black et al. |
| 2017/0205170 | A1 | 7/2017 | Milde, Jr. |
| 2022/0390200 | A1* | 12/2022 | Faizan ..... F41A 17/063 |

FOREIGN PATENT DOCUMENTS

| | | | |
|---|---|---|---|
| CN | 201397085 | Y | 2/2010 |
| EP | 1605222 | A1 | 12/2005 |
| WO | 2014163653 | A1 | 10/2014 |
| WO | 2015116021 | A1 | 8/2015 |

* cited by examiner

SMART-GUN ARTIFICIAL INTELLIGENCE SYSTEMS AND METHODS

CROSS-REFERENCE TO RELATED APPLICATIONS

This application is a continuation-in-part (CIP) of U.S. application Ser. No. 17/200,072, filed Mar. 12, 2021, which is a continuation of U.S. application Ser. No. 16/274,791, filed Feb. 13, 2019, which is a continuation of U.S. application Ser. No. 15/430,354, filed Feb. 10, 2017, which is a non-provisional of U.S. Provisional Application Ser. No. 62/294,171, filed Feb. 11, 2016, which applications are hereby incorporated herein by reference in their entirety and for all purposes.

BACKGROUND

The evolution of firearm technology has brought about significant advancements in terms of firepower, precision, and reliability. However, traditional firearm systems without the integration of artificial intelligence (AI) are inherently limited in addressing certain critical aspects related to safety and shooter training.

Traditional firearm systems rely on purely mechanical safety mechanisms and manual controls to prevent accidental discharges and unauthorized access. While these measures are effective to some extent, they inherently lack the sophistication and adaptability that could be offered by AI-powered safety features. Accordingly, traditional firearm systems remain vulnerable to misuse, accidents, and unauthorized access.

Effective shooter training can be important for developing consistent safety practices, marksmanship skills, tactical proficiency and situational awareness. However, conventional training methods fail to provide immersive, personalized, and adaptive learning experiences tailored to individual shooter needs and based on real-time actions of a user. Conventional firearm training systems fail to adequately provide real-time feedback or adjust training protocols based on real-time and historical shooter performance and learning objectives, resulting in suboptimal training outcomes and limited skill development.

In view of the foregoing, a need exists for improved smart-gun artificial intelligence systems and methods in an effort to overcome the aforementioned obstacles and deficiencies of conventional firearm systems.

Figure 1:
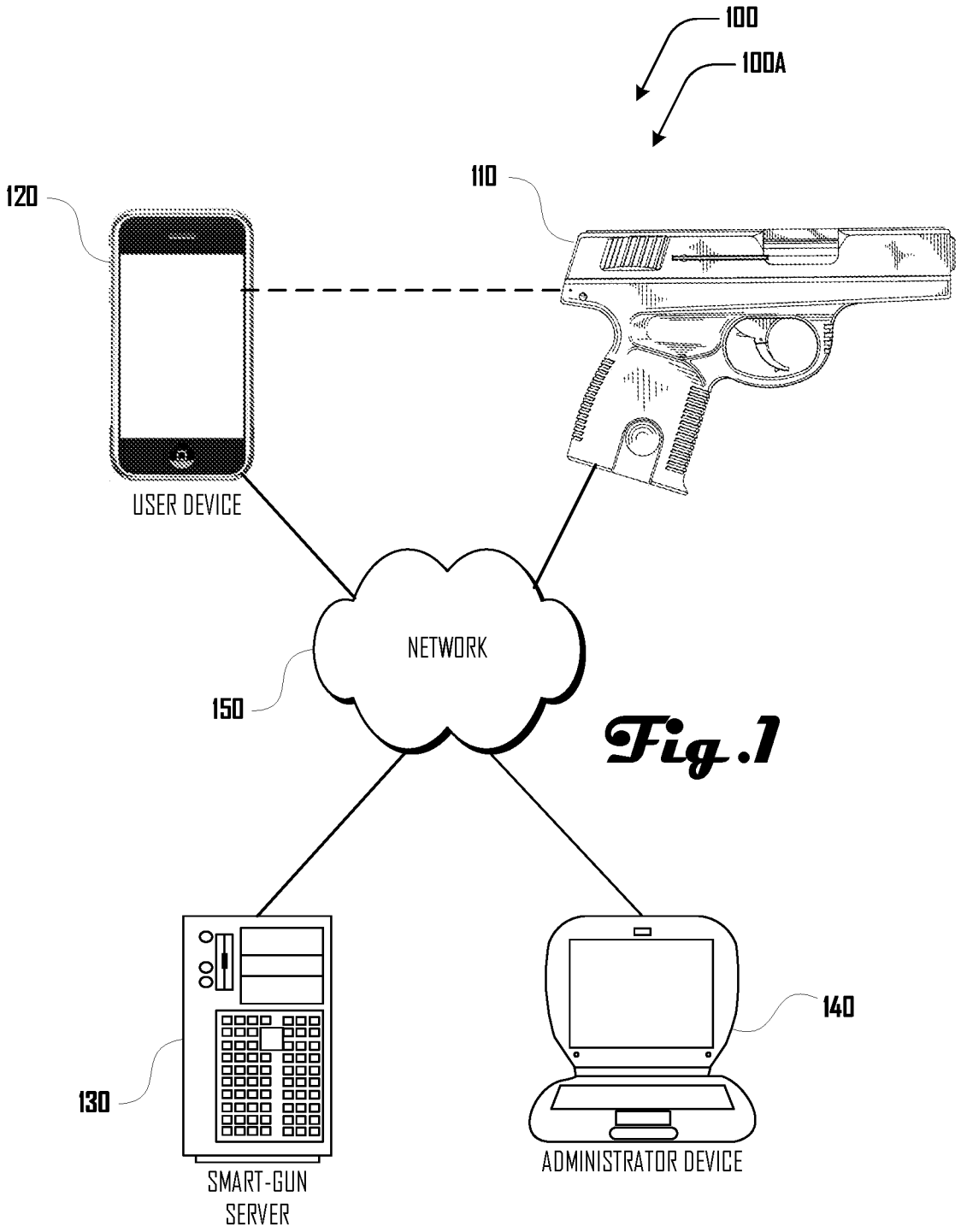
FIG. 1 is an exemplary top-level drawing illustrating an example embodiment of a smart-gun system.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Various embodiments of the present disclosure relate to computerized smart-guns that include sensors configured to obtain data about the smart-gun such as orientation, movement and direction along with information about the state(s) of the smart-gun such as whether it is loaded, firing state(s), on/off safety, and the like. In various embodiments, smart-guns and/or associated devices can have microphones or cameras to capture video or audio data and can include speakers and/or displays to present audio or visual data to a user.

Such smart-gun data can be used in various embodiments by artificial intelligence to identify various states or conditions of the smart-gun along with states and conditions of a user of the smart-gun, which can be used to change one or more configurations of the smart-gun, provide alerts to the user or others, and the like. For example, where artificial intelligence identifies an unsafe situation as discussed in detail herein, the smart-gun can be automatically disabled or put on safety and/or an audio alert can be provided to the user or others.

In various embodiments, such smart-gun data can be used to initiate and conduct conversations with a user of the smart-gun, such as via text-to-speech based on responses received from an artificial intelligence system such as a Large Language Model (LLM). Accordingly, in various embodiments, a smart-gun system can be configured to actively and interactively communicate with a user of a smart-gun 110 in real-time based on the user speaking, based on smart-gun data, and the like. Such communications to and with a user can be for various suitable purposes such as to improve safety, improve user firearm skills, improve user firearm knowledge, improve tactical skills, improve performance in a tactical situation, improve safety in a tactical situation, and the like. In various embodiments, such communications can be in any suitable synthesized voice or in any suitable persona or character such as a range master, shooting coach, drill instructor, squad leader, commander, or the like.

Accordingly, various embodiments of artificial intelligence enabled smart-gun systems can be configured to improve firearm safety in a variety of settings, such as at a gun range, during training exercises and in tactical situations. Additionally, various embodiments of artificial intelligence enabled smart-gun systems can be configured to improve learning by a shooter such as basic firearm handling and safety, improving shooting accuracy and precision, tactical skills, and the like. Additionally, various embodiments of artificial intelligence enabled smart-gun systems relate to a group of users with smart-guns such as a plurality of shooters at a gun range or a team of military or law enforcement personnel that may be engaging in a training exercise or tactical operation.

Turning to FIG. 1, an example embodiment 100A of a smart-gun system 100 is shown as comprising a smart-gun 110, a user device 120, a smart-gun server 130 and an administrator device 140, which are operably connected via a network 150. Additionally, the user device 120 and smart-gun 110 are illustrated as being directly operably connected.

Although a semi-automatic handgun is illustrated as an example smart-gun 110 in accordance with some example embodiments of the present invention, it should be clear that various suitable guns can be implemented as a smart-gun 110. For example, in further embodiments a smart-gun 110 can comprise a rifle, pistol, shotgun, machine gun, submachine gun, paintball gun, pellet gun, or the like. Additionally, any suitable weaponry can be associated with a smart-gun system 100, including a rocket launcher, rocket-propelled grenade (RPG) launcher, mortar, cannon, heavy machine gun, Gatling gun, or the like. Such guns or weapons can be handheld, ground-based, mounted on a vehicle, mounted on a drone, or the like.

Although a smartphone is illustrated as a user device 120 and a laptop computer is illustrated as being an administrator device 140, in further embodiments, any suitable device can serve as a user device 120 or administrator device 140. For example, in various embodiments one or both of the user device 120 and administrator device 140 can comprise a smartphone, wearable computer, laptop computer, desktop computer, tablet computer, gaming device, television, home automation system, or the like. Additionally, the smart-gun server 130 can also comprise any suitable server system including cloud- and non-cloud-based systems.

The network 150 can comprise any suitable network, including one or more local area networks (LAN), wide area networks (WAN), or the like. The network 150 can comprise one or more Wi-Fi network, cellular network, satellite network, and the like. Such a network 150 can be wireless and/or non-wireless. As discussed herein, the smart-gun 110 and user device 120 can be connected via a suitable network 150 and/or can be directly connected via a Bluetooth network, near-field communication (NFC) network, and the like.

Accordingly, the smart-gun 110, user device 120, smart-gun server 130, and administrator device 140 can be configured to communicate via one or more suitable networks and/or network protocols. For example, in some embodiments, the smart-gun 110 can be operable to communicate via Bluetooth, Wi-Fi, a cellular network, a satellite network and/or a near-field network.

In further embodiments, the smart-gun 110 can be inoperable to communicate via certain networks or via certain network protocols. For example, in some embodiments, the smart-gun 110 can be limited to only communicating via short-range wireless communications such as Bluetooth or near-field communications and can be inoperable for communication via longer-range networks such as Wi-Fi or a cellular network. In such embodiments, the smart-gun 110 can be configured to communicate with devices such as the smart-gun server 130 and/or administrator server 140 via the user device 120, which can serve as a gateway to longer-range networks and/or functionalities. Such embodiments can be desirable because the smart-gun 110 can operate with minimal hardware and power consumption, yet still access longer-range networks and/or functionalities via the user device 120.

In various embodiments, a smart-gun system 100 can comprise any suitable plurality of any of the smart-gun 110, user device 120, smart-gun server 130, and/or administrator device 140. For example, in some embodiments, there can be a plurality of smart-guns 110, which are each associated with a respective user device 120. In another example, a plurality of smart-guns 110 can be associated with a given user device 120. In a further example, a plurality of user devices 120 can be associated with a given smart-gun 110. In some embodiments, one or more of the user device 120, smart-gun server 130 or administrator server 140 can be absent from a smart-gun system 100.

In embodiments where the smart-gun system 100 comprises a plurality of smart-guns 110 and/or user devices 120, each smart-gun 110 and/or user device 120 can be associated with at least one identifier which may or may not be a unique identifier. For example, in some embodiments, such an identifier can include a serial number (e.g., stored in a memory, firmware, or the like), a Media Access Control (MAC) address, a Mobile Station International Subscriber Directory Number (MSISDN), a Subscriber Identity Module (SIM) card, or the like. Such identifier(s) can be permanently and/or removably associated with the smart-gun 110 and/or user device 120. For example, in some embodiments various types of SIM cards can be associated with a smart-gun 110 and/or user device 120 including Full Sized SIMs, Micro-SIMS, Nano-SIMS, and the like. As discussed in more detail herein, one or more smart-gun identifiers can be used to lock or unlock a smart-gun 110.

Figure 2:
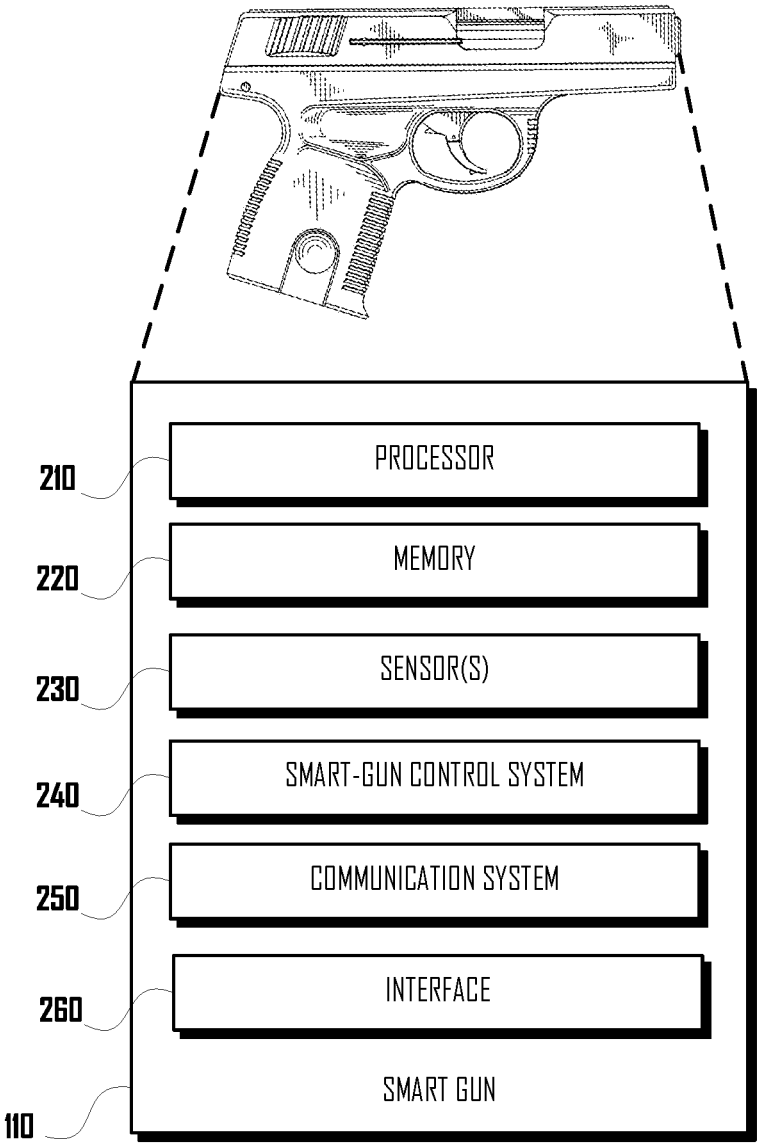
FIG. 2 illustrates one example embodiment of a smart-gun, which can comprise, a processor, a memory, one or more sensors, a smart-gun control system, a communication system, and an interface.

A smart-gun 110 can comprise various suitable elements. For example, FIG. 2 illustrates one example embodiment of a smart-gun 110, which can comprise a processor 210, a memory 220, one or more sensors 230, a smart-gun control system 240, a communication system 250, and an interface 260.

For example, in some embodiments, a smart-gun 110 can comprise a computing device which can be configured to perform methods or portions thereof discussed herein. The memory 220 can comprise a computer-readable medium that stores instructions, that when executed by the processor 210, causes the smart-gun 110 to perform methods or portions thereof discussed herein, or other suitable functions. The sensors 230 can include various suitable sensors including gyroscope, magnetometer, camera, microphone, compass, proximity sensor, barometer, ambient light sensor, pedometer, thermometer, humidity sensor, heart rate sensor, fingerprint sensor, face id sensor, infrared sensor, ultrasonic sensor, pressure sensor, gravity sensor, linear acceleration sensor, rotation vector sensor, orientation sensor, GPS sensor, and the like.

The smart-gun control system 240 in various embodiments can be configured to control various electronic and/or mechanical aspects of the smart-gun 110 based on instructions from the processor, or the like. For example, such aspects can include control of a trigger mechanism, firing pin, hammer, safety lock, slide release, magazine release, trigger sensitivity, barrel rotation, recoil management, bullet chambering, bullet ejection, sight adjustment, laser sight control, muzzle brake, integrated accessory control, and the like. Additionally, in some embodiments, the smart-gun control system 240 can determine various aspects, characteristics or states of the smart-gun 110 such as identifying loaded ammunition type, magazine presence/absence, jammed state, operable state, need for lubrication or other maintenance, issues with sights, number of rounds remaining in a magazine, rounds remaining in the chamber(s), safety on/off, or the like.

In various embodiments, the communication system 250 can be configured to allow the smart-gun 110 to communicate via one or more communication networks as discussed herein, which in some embodiments can include wireless and/or wired networks and can include communication with devices such as one or more other smart-guns 110, user devices 120, servers 130, admin devices 140, or the like as discussed herein.

The interface 260 can include various elements configured to receive input and/or present information (e.g., to a user). For example, in some embodiments, the interface can comprise a touch screen, one or more buttons, one or more lights, a speaker, a microphone, a haptic interface, a projector, and the like. In various embodiments, the interface 260 can be used by a user for various suitable purposes, such as to communicate with an artificial intelligence (AI), configure the smart-gun 110, view an aspect, characteristic or state of the smart-gun 110, configure network connections of the smart-gun 110, or the like. In some embodiments, the interface 260 can be part of a sighting system such as a reflex sighting system, scope, camera sight (e.g., night vision or thermal), iron sights, laser sight, or the like.

The smart-gun 110 can be powered by any suitable system configured to store and discharge energy. For example, in some embodiments, the one or more batteries can comprise Lithium-ion (Li-ion), Lithium-ion Polymer (Li-Po), Nickel-Metal Hydride (NiMH), Nickel-Cadmium (NiCd), Alkaline, Zinc-Carbon batteries, or the like. In some embodiments, the one or more batteries can contain or be defined by removable cartridges that allow the one or more batteries to scale or be replaced. Battery packs in some examples can be composed of small sub-packs that can be easily removed. In some examples, one or more batteries can be integral to the smart-gun 110 and not removable. In some embodiments such batteries can be rechargeable.

It should be clear that the example of FIG. 2 is only one example embodiment of a smart-gun 110 and that smart-guns 110 having fewer or more elements or having more or less complexity are within the scope and spirit of the present disclosure. For example, one or more of the elements of FIG. 2 can be specifically absent in some embodiments, can be present in any suitable plurality, or the like. In some embodiments, a communication system 250 can be absent and the smart-gun 110 can be inoperable for wired and/or wireless communication with other devices. The interface 260 can comprise a plurality of interface elements or a complex interface in some examples, or can be a simple interface 260 in some embodiments, or can be absent. In some embodiments, an interface for the smart-gun 110 can be embodied on a separate device such as a user device 120 (e.g., a smartphone, laptop, embedded system, home automation system, or other suitable device).

Figure 3:
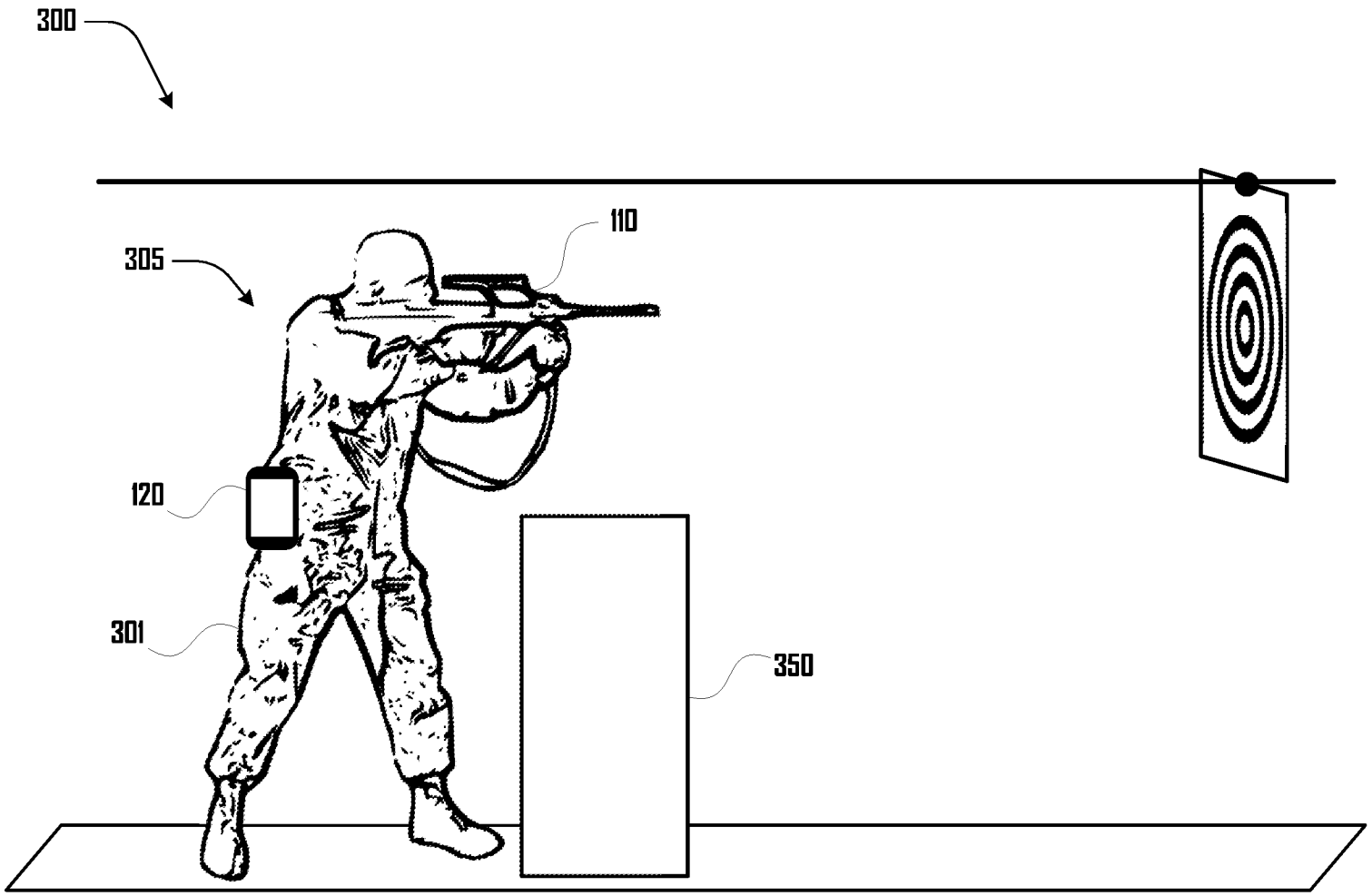
FIG. 3 illustrates an embodiment of a shooting range that includes a range device.

Turning to FIG. 3, an embodiment of a shooting range 300 is illustrated, which includes a range device 350. A user 301 is shown at the shooting range 300 having a shooter system 305 that in this example comprises a smart-gun 110 and a user device 120. However, in further embodiments, a user device 120 may be absent or the shooter system 305 can comprise additional suitable elements as discussed herein.

While the example of FIG. 3 illustrates the range device 350 as part of a shooting table of a shooting booth, it should be clear that the range device 350 can comprise various suitable elements disposed in various suitable locations of a shooting range and the example of FIG. 3 is provided for the purpose of simplicity and should not be construed as limiting. For example, in some embodiments, a range device 350 can comprise various suitable sensors as discussed herein (see e.g., sensors 230) such as a camera, microphone, and the like, which can be disposed in various suitable locations and present in any suitable plurality in some examples. In various embodiments, a range device 350 can have elements and/or functionalities of other devices discussed herein, such as a smart-gun 110 (e.g., FIG. 2), a user device 120, a smart-gun server 130, and admin device 140, or the like. For example, in some embodiments, an admin device 140 can comprise a range device 350. In some embodiments, a range device 350 can be absent from a shooting range 300 and a user 301 can shoot at the shooting range 300 with just a shooter system 305. In some embodiments, a shooting range 300 with a range device 350 can operate with a shooter system 305, smart-gun 110 and/or user device 120 being absent.

As discussed in more detail herein, in various embodiments one or more of a range device 350, shooter system 305, smart-gun 110 and user device 120 at a shooting range 300 can be configured to monitor, assist or instruct a user 301 such as by identifying situations when a user is carrying a gun, loading a gun, preparing to fire, firing, etc., or more specific situations such as where a user is being unsafe and acting erratically, not practicing proper muzzle discipline or does not appear to realize that their gun is off safety or loaded and is being unsafe. Where the user 301 has a smart-gun 110, actions could be taken as discussed in more detail herein such as to disable the gun, alert the user 301, alert administrators, or the like, based on the situation and other context identified by, or based on data from, one or more of a range device 350, shooter system 305, smart-gun 110 and user device 120.

Figure 4:
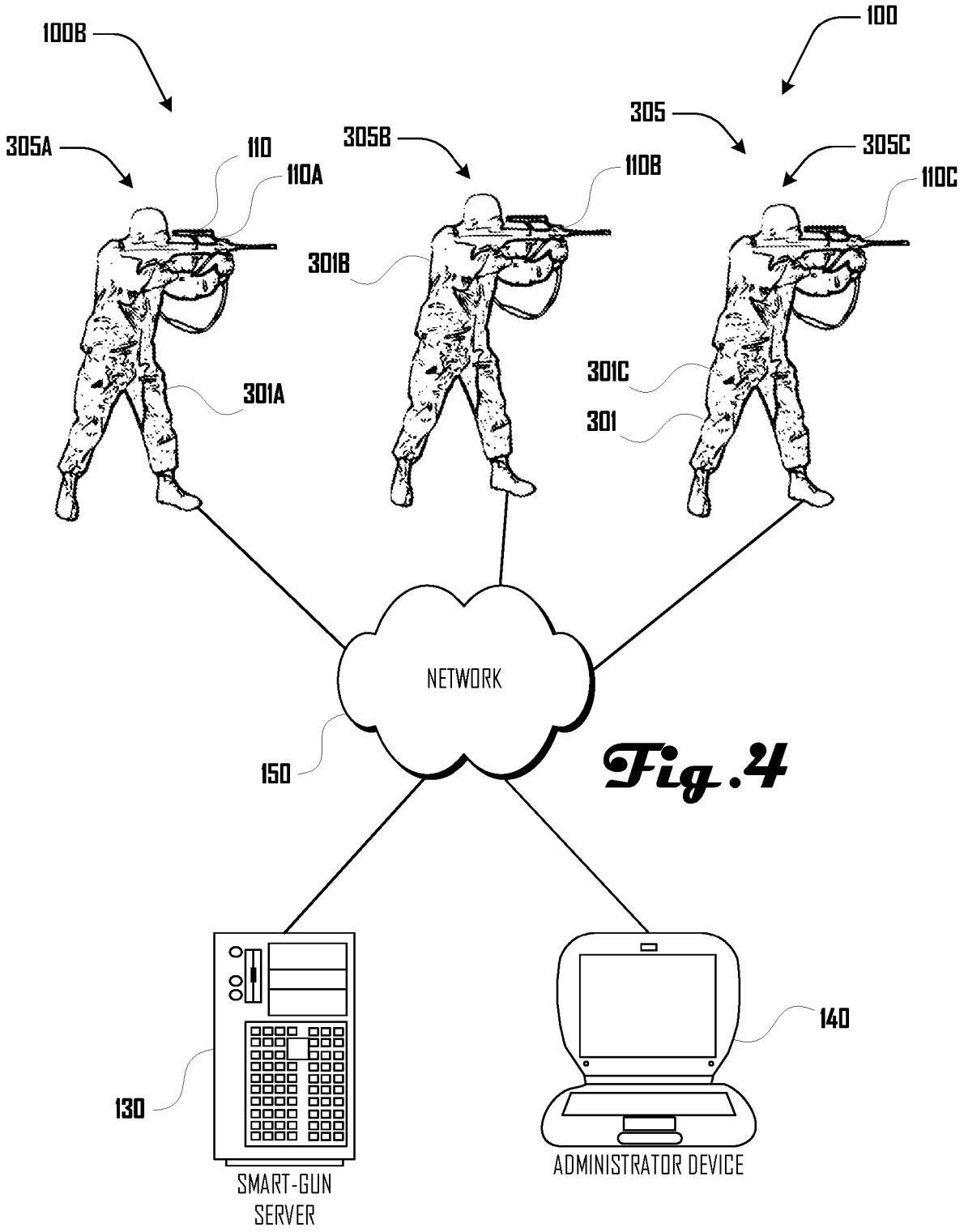
FIG. 4 illustrates another embodiment of a smart-gun system that comprises a plurality of users that each are associated with a respective shooter system that at least comprises a respective smart-gun in this embodiment.

Turning to FIG. 4, another embodiment 100B of a smart-gun system 100 is illustrated, which comprises a plurality of users 301, which each are associated with a respective shooter system 305 that at least comprises a respective smart-gun 110 in this embodiment. For example, a squad of a first, second and third user 301A, 301B, 301C can include military personnel, law enforcement personnel, or the like, which can be acting in a tactical engagement, training drill, or the like. In some embodiments, the plurality of users 301 can be a set of shooters at a shooting range 300. In some embodiments, a given user 301 can have a plurality of smart-guns 110 (e.g., a long gun and a side-arm).

As discussed in more detail herein, artificial intelligence can be trained based at least in part on data from one or more of a plurality of users 301, one or more respective shooter systems 305, one or more smart-guns 110, or the like. As further discussed in more detail herein, artificial intelligence can be used to support a plurality of users 301 such as shown in FIG. 4.

In various embodiments, artificial intelligence can be used in various aspects of smart-gun systems and methods. For example, in one aspect an artificial intelligence system (e.g., a neural network) can be trained to identify states of smart-gun 110 and/or states of one or more users 301 of a smart-gun 110. Such identified states can be used to determine a response such as locking the smart-gun 110, initiating an auditory conversation with a user (e.g., via a Large Language Model (LLM)), presenting an alert to a user (e.g., auditory, visual or haptic), or the like.

Figure 5:
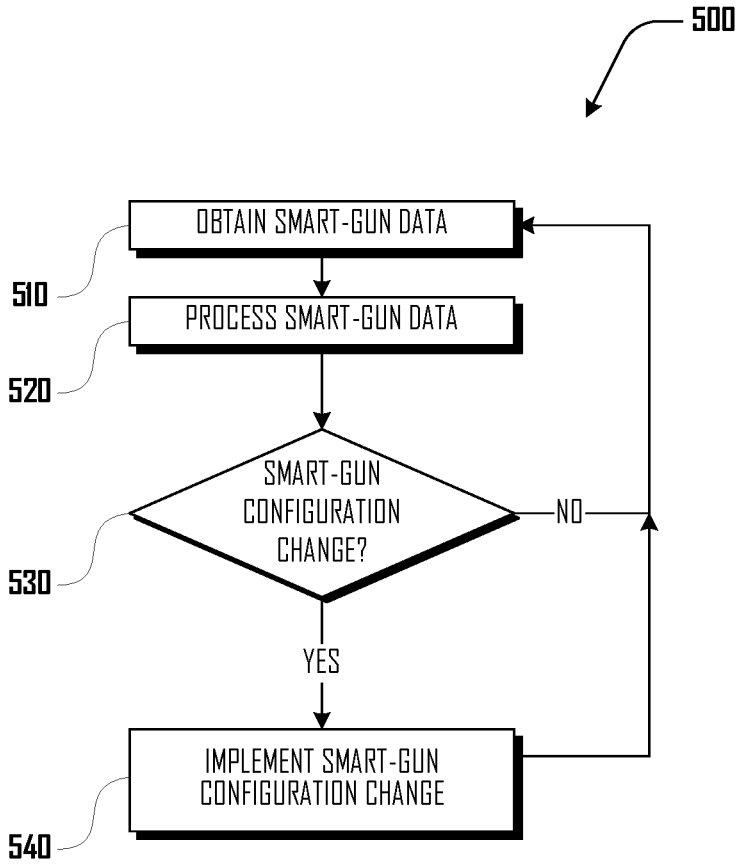
FIG. 5 illustrates an example embodiment of a method of implementing a smart-gun configuration change based on obtained smart-gun data.

For example, FIG. 5 illustrates an example embodiment of a method 500 of implementing a smart-gun configuration change based on obtained smart-gun data, which in some embodiments can be performed in full or in part by one or more suitable devices such as a smart-gun 110, range device 350, user device 120, smart-gun server 130, admin device 140, or the like. The method 500 begins at 510, where smart-gun data is obtained and then processes at 520. In some embodiments, smart-gun data can comprise any suitable data obtained from sensors 230 of a smart-gun 110 (see e.g., FIG. 2), which can include smart-gun orientation data, location data, smart-gun state data, audio data obtained from a microphone, video data obtained from a camera, data regarding a current user 301 of the smart-gun 110, and the like.

In various embodiments, processing the obtained smart-gun data can comprise determining one or more states of the smart-gun 110, one or more states of the user 301 of the smart-gun 110, one or more environmental states proximate to the user 301 and smart-gun 110, one or more states of other users 301 in the area, a safety state, and the like.

For example, in one embodiment and using the example of a user 301 and smart-gun 110 at a shooting range 300 (see e.g., FIG. 3), obtained smart-gun data can be processed to determine that the user 301 of the smart-gun 110 is acting in a way or handling or operating the smart-gun 110 in a way that is below a minimum safety threshold. For example, obtained smart-gun data can include smart-gun state data indicating that the smart-gun 110 is loaded and off safety and can include data indicating that the smart-gun is oriented in a direction away from the target area of the gun range 300 (e.g., greater than +/−20° from directly perpendicular to the fire-line of the gun range 300); is being held by the user 301 or otherwise disposed at an unsafe angle (e.g., greater than +/−45° from horizontal); that the user 301 is located an unsafe distance from the fire-line or shooting booth; or the like.

Analysis of such data can be used to determine that the user 301 of the smart-gun 110 is acting in a way or handling or operating the smart-gun 110 in a way that is below a minimum safety threshold. For example, such a safety analysis can be based on data meeting or not meeting various criteria, being input into a neural network trained to analyze such data, or the like. In some embodiments, a minimum safety threshold can be different or customized (e.g., by an operator of the gun range 300 via an admin device 140) based on a skill level associated with the user 301 of the smart-gun 110, history of previous safety violations by the user 301 of the smart-gun 110, type of smart-gun 110, type of ammunition present in the smart-gun 110, and the like.

Returning to the method 500 of FIG. 5, at 530, a determination is made whether a smart-gun configuration change should be made, and if so, the smart-gun configuration change is implemented at 540. If not, the method 500 cycles back to 510 where further smart-gun data is obtained.

For example, returning to the safety example above, where a determination is made that the user 301 of the smart-gun 110 is acting in a way or handling or operating the smart-gun 110 in a way that is below a minimum safety threshold, a determination can be made to disable to the smart-gun 110 such that it is inoperable to fire, such as by engaging a safety, disabling a firing mechanism, preventing chambering of a round, preventing loading of a magazine, or the like. In some embodiments, a determination can be made to generate an alert such as by having the smart-gun 110 or a range device 350 sound, flash or vibrate an alarm to alert the user 301, other users 301, or a range master. One or more such determined configuration change in response to the determined unsafe activity can be implemented in the smart-gun 110 (and/or other suitable device), including by the smart-gun 110 itself implementing the one or more configuration changes or another suitable device communicating with the smart-gun 110 as discussed herein to implement the one or more configuration changes.

In some embodiments, a determined response can be based on a determined level of safety such as safe, slightly unsafe, moderately unsafe, or extremely unsafe. For example, where activity is deemed to be only slightly unsafe, a light on the smart-gun 110 can be configured to blink and the smart-gun configured to be put on safety. However, where activity is deemed to be extremely unsafe, a loud alarm on the smart-gun, multiple or more extreme disabling actions can be implemented, and alerts can be sent to a range master. Accordingly, in some examples, a smart-gun system 100 can be configured to have a proportioned response to a determined level of safety or un-safety.

In some embodiments, velocity can used to determine a level of safety or un-safety. For example, where velocities over a certain threshold, duration, or the like are detected (e.g., via velocity sensors, camera, or the like) a determination can be made that the user 301 is swinging the smart-gun 110 around in an extremely unsafe and reckless manner. However, velocities within or below a certain threshold or duration can be indicative of the user 301 making an honest mistake. Accordingly, in some examples, a smart-gun system 100 can be configured to have a proportioned response to a determined level of safety or un-safety based on velocity of movement of a smart-gun 110.

In some embodiments, visual and/or audio data from a camera and/or microphone can be used to determine a level of safety or un-safety. For example, where audio data is analyzed to determine that one or more persons are yelling, slurring speech, identifying sound(s) associated with an altercation, or the like, a determination can be made that an extremely dangerous situation may be present based on one or more users 301 being intoxicated, aggravated or acting aggressively. In another example, video data can be analyzed to determine that one or more users 301 are acting aggressively, acting un-safely, may be intoxicated, or the like, and a determination can be made that a dangerous situation may be present. Accordingly, in some examples, a smart-gun system 100 can be configured to have a proportioned response to a determined level of safety or un-safety based on analysis of visual and/or audio data.

In various embodiments, in addition to a determination being made of safety being below a minimum threshold or certain level, a determination can be made that safety has returned to above a minimum threshold or certain level and a smart-gun 110 can be configured based on such a determination to cancel or undo a response to an identified lack of safety or otherwise change a configuration of the smart-gun 110 based on the determination that safety has returned to above a minimum threshold or to a certain level.

Configurations of smart-guns 110 and other devices can be determined and implemented based on various other rules, regulations, or the like. In one example, a gun range can identify a set of rules, which may be applicable to all users 301 generally or applicable to specific users 301 such as based on the use history of the user 301, skill level of the user 301, admin status of the user 301, and the like. For example, a gun range can prohibit, for some or all users 301, use of certain types of ammunition, certain types of smart-guns, certain types of muzzle discipline, certain types of firing positions, and the like. Configurations of one or more smart-guns 110 can be determined and implemented accordingly.

Configurations of smart-guns 110 and other devices can be determined and implemented based on identity of a user 301 handling a smart-gun 110 and various embodiments of a smart-gun system 100 can be configured to determine the identity of a user 301 handling a smart-gun 110, which in some examples can include use of biometric sensors or unique indicators such as fingerprints, hand-prints, face, voice recognition, and the like. For example, where a given user is not authorized to use a given smart-gun 110 (e.g., because they are generally prohibited from using smart-guns 110 at a gun range 300, they are prohibited from using certain smart-guns 110 based on experience or qualification level, or the like), a smart-gun 110 can be configured to be disabled or an alert generated as discussed herein where such a user 301 is handling or operating an unauthorized smart-gun 110.

In some embodiments, a smart-gun system 100 can be configured to determine when an authorized user 301 hands a smart-gun 110 to an unauthorized user 301 and disable the smart-gun 110 or generate an alert based on such a transfer. In some embodiments, a smart-gun system 100 can be configured to determine when an unauthorized user 301 hands a smart-gun 110 to an authorized user 301 and enable the smart-gun 110 or cancel or modify an alert based on such a transfer. For example, artificial intelligence can be used to analyze video to identify different users, track movement of different users, identify users holding or not holding smart-guns 110, identify the identity of a smart-gun 110 being held by a given user 301, a transfer action between a first user 301 and a second user 301, and the like. In various embodiments, other data discussed herein can be used, including smart-gun position data, smart-gun orientation data, smart-gun velocity data, and the like.

In some examples, artificial intelligence can be used to analyze video to identify various states or actions of a user 301 and/or smart-gun 110 such as when the user 301 is loading the smart-gun 110, changing a magazine of the smart-gun 110, aiming the smart-gun 110, preparing to fire the smart-gun 110, is in a standing shooting stance with the smart-gun 110, is in a kneeling shooting stance the smart-gun 110, is in a prone shooting position the smart-gun 110, is walking with the smart-gun 110, is crouching with the smart-gun 110, is running with the smart-gun 110, is performing maintenance on the smart-gun 110, and the like. In various embodiments, other data discussed herein can be used to identify various states or actions of a user 301 and/or smart-gun 110, including smart-gun position data, smart-gun orientation data, smart-gun velocity data, and the like.

While some examples herein relate to a single user 301 with a single smart-gun 110, it should be clear that further embodiments can relate to any suitable plurality of users 301 with each of the plurality of users 301 having one or more smart-guns 110 (see e.g., FIG. 4). Additionally, smart-gun data discussed herein can be obtained from a plurality of smart-guns 110 and can be used to determine and implement configurations for one or more smart-guns 110 which may or may not include the one or more smart-guns 110 that the smart-gun data was obtained from.

In various embodiments, smart-gun data obtained from a plurality of smart-guns 110 of a squad of military or law enforcement personnel can be used to determine and implement configurations for one or more smart-guns 110 of the squad or otherwise assist with supporting or supervising the squad. For example, smart-gun location data, orientation data, velocity data, and the like, can be used to identify the relative positions of the users 301 and where their respective smart-guns 110 are pointed and selectively disable smart-guns 110 and/or provide alerts to one or more users 301 to prevent or reduce the likelihood of friendly fire events or to direct fire at enemy targets. In another example, smart-gun location data, orientation data, velocity data, and the like, can be used to identify where users 301 will likely be located in the future and where their smart-guns 110 will likely be pointed in the future and selectively disable smart-guns 110 and/or provide alerts to one or more users 301 to prevent or reduce the likelihood of friendly fire events or to direct fire at enemy targets.

In some embodiments, artificial intelligence can be used to identify and predict squad movements and predict line or field of fire, which can be used to selectively disable smart-guns 110 and/or provide alerts to one or more users 301 to prevent or reduce the likelihood of friendly fire events or to direct fire at enemy targets. For example, where artificial intelligence predicts that one or more members of a squad will move into a position where they will be in the line or field of fire of another squad member, then an alert can be sent to that squad member to change or stop their movement to prevent or reduce the likelihood of an unsafe situation. In another example, where artificial intelligence predicts that another squad member will be in the line or field of fire of a given squad member, then an alert can be sent to that squad member to change or stop their movement, or to change their muzzle direction to prevent or reduce the likelihood of an unsafe situation. In another example, artificial intelligence can predict the movement of one or more enemy targets and can determine an ideal location and/or muzzle direction of one or more squad members to most effectively engage such enemy targets and direct the position and/or muzzle direction of one or more squad members to direct the squad into an ideal position to engage the enemy targets. In some embodiments, artificial intelligence can determine an optimal configuration of various aspects of one or more smart-guns 110 for purposes of squad safety and/or engaging one or more enemy targets and can implement such changes in the one or more smart-guns 110. For example, such configuration changes can include rate of fire, type of ammunition, type or configuration of sight, on/off safety, suppressor configuration. In some embodiments, artificial intelligence can be used to automatically change various configurations of one or more smart-guns 110 without user or admin interaction or can be used to suggest changes to various configurations of one or more smart-guns 110 for approval or selection by a user or admin.

Figure 6:
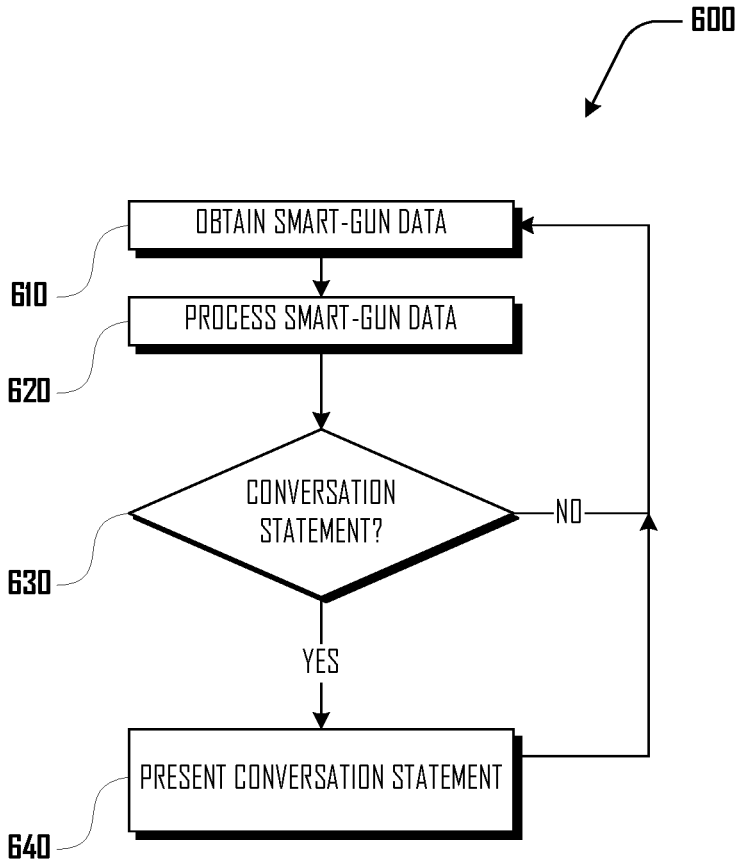
FIG. 6 illustrates an example embodiment of a method of conversing with a user based on obtained smart-gun data.

For example, FIG. 6 illustrates an example embodiment of a method 600 of conversing with a user based on obtained smart-gun data, which in some embodiments can be performed in full or in part by one or more suitable devices such as a smart-gun 110, range device 350, user device 120, smart-gun server 130, admin device 140, or the like. The method 600 begins at 610, where smart-gun data is obtained and then processes at 620. In some embodiments, smart-gun data can comprise any suitable data obtained from sensors 230 of a smart-gun 110 (see e.g., FIG. 2), which can include smart-gun orientation data, location data, smart-gun state data, audio data obtained from a microphone, video data obtained from a camera, data regarding a current user 301 of the smart-gun 110, and the like. In some embodiments, smart-gun data can include current conversation data, previous conversation data, user profile data, and the like.

In various embodiments, processing the obtained smart-gun data can comprise determining one or more states of the smart-gun 110, one or more states of the user 301 of the smart-gun 110, one or more environmental states proximate to the user 301 and smart-gun 110, one or more states of other users 301 in the area, a safety state, and the like.

For example, in one embodiment and using the example of a user 301 and smart-gun 110 at a shooting range 300 (see e.g., FIG. 3), obtained smart-gun data can be processed to determine that the user 301 of the smart-gun 110 is acting in a way or handling or operating the smart-gun 110 in a way that is below a minimum safety threshold. For example, obtained smart-gun data can include smart-gun state data indicating that the smart-gun 110 is loaded and off safety and can include data indicating that the smart-gun is oriented in a direction away from the target area of the gun range 300 (e.g., greater than +/−20° from directly perpendicular to the fire-line of the gun range 300); is being held by the user 301 or otherwise disposed at an unsafe angle (e.g., greater than +/−45° from horizontal); that the user 301 is located an unsafe distance from the fire-line or shooting booth; or the like.

Analysis of such data can be used to determine that the user 301 of the smart-gun 110 is acting in a way or handling or operating the smart-gun 110 in a way that is below a minimum safety threshold. For example, such a safety analysis can be based on data meeting or not meeting various criteria, being input into a neural network trained to analyze such data, or the like. In some embodiments, a minimum safety threshold can be different or customized (e.g., by an operator of the gun range 300 via an admin device 140) based on a skill level associated with the user 301 of the smart-gun 110, history of previous safety violations by the user 301 of the smart-gun 110, type of smart-gun 110, type of ammunition present in the smart-gun 110, and the like.

Returning to the method 600 of FIG. 6, at 630, a determination is made whether a conversation statement should be made, and if so, the determined conversation statement is presented at 640. If not, the method 600 cycles back to 610 where further smart-gun data is obtained.

For example, returning to the safety example above, where a determination is made that the user 301 of the smart-gun 110 is acting in a way or handling or operating the smart-gun 110 in a way that is below a minimum safety threshold, a determination can be made to direct a conversation statement to the user 301, which may include an audio statement presented via a microphone of the smart-gun 110, a user device 120, range device 350, or the like. In some embodiments, a conversation statement can include a text or other visual presentation, which may be via an interface of the smart-gun 110, a user device 120, range device 350.

In various embodiments, generating a conversation statement can include generating and submitting a prompt to a Large Language Model (LLM), obtaining a response from the LLM in response to the submitted prompt, and presenting the response, at least in part, as a conversation statement to the user 301. In various embodiments, an LLM can be hosted on one or more devices that are remote from a device that generates and/or sends a prompt to the LLM. For example, in one embodiment, a smart-gun 110 and/or user device 120 can generate and/or send a prompt via a network 150 to an LLM hosted on an LLM server, a smart-gun server 130, admin device 140, or the like. In some embodiments, an LLM can be hosted on a smart-gun 110 or user device 120.

In some embodiments, a determination can be made to present a conversation statement in a shooting range 300 by having the smart-gun 110 or a range device 350 speak, play or display a conversation to the user 301, other users 301, or a range master. In some examples, a prompt and/or generated conversation statement can be generated based on a determined state or activity of the user 301 and/or smart-gun 110 such as the user 301 not pointing a loaded and off-safety smart-gun 110 sufficiently down-range; the user acting in a manner where they may not be aware that the smart-gun 110 is loaded; the user 301 not holding a loaded and off-safety smart-gun 110 at a safe angle; the user 301 having unauthorized ammunition in a smart-gun 110; the user being unauthorized to operate a smart-gun 110 they are holding; the smart-gun 110 having unauthorized settings (e.g., multiple round bursts or full automatic); the user 301 being in an unauthorized shooting stance or position; the user acting in an aggressive or unsafe manner; and the like. In various embodiments, a prompt and/or generated conversation statement can reference the state or activity of the user 301 and/or smart-gun 110. For example, including state or activity of the user 301 and/or smart-gun 110 in a prompt can result in a generated conversation statement such as "Please point your weapon down-range", "Are you aware that your gun is loaded?", "Are you aware that your gun is off-safety?", "Watch your muzzle angle", "You are not authorized to use that ammo", "You are not authorized to use that gun", "That gun is not authorized to be used at this range", "Please only fire with semi-auto", "Prone shooting is not allowed on this range", "You need to calm down", and the like.

In some examples, a prompt and/or generated conversation statement can be generated based on a determined level of safety such as safe, slightly unsafe, moderately unsafe, or extremely unsafe. For example, where activity is deemed to be only slightly unsafe, and this characteristic is included in a prompt, a generated prompt can be more friendly, presented with a friendlier tone, presented at a lower volume, presented with a more friendly character voice, or the like. However, where activity is deemed to be extremely unsafe, and this characteristic is included in a prompt, a generated prompt can be more aggressive, presented with a stern tone, presented at a higher volume, presented with a more aggressive character voice (e.g., as a police officer, drill sergeant, security officer, or the like). Accordingly, in some examples, a smart-gun system 100 can be configured to have a proportioned response to a determined level of safety or unsafety such that users 301 are treated with respect and dignity when they are or have been making a good faith effort to comply with rules and such that users who are blatantly disregarding rules, acting recklessly or are putting themselves in extreme danger are dealt with aggressively and strongly to get the attention of the user 301, to obtain compliance and to make the danger of the situation clear to the user 301 and others that may be around the offending user 301.

In various embodiments, a prompt and/or generated conversation statement can be generated based on a user history or profile, which can include aspects of a current conversation session; aspects of one or more previous conversation sessions; a user disciplinary history; a user skill or qualification level; one or more user authorizations; or the like. In some examples, an LLM can hold a history of a current and/or previous conversations with a given user and can adapt a first and subsequent conversation statements accordingly. For example, where a user 301 has not been previously warned about a safety infraction, a first conversation statement regarding the safety infraction can be in a more friendly, and non-accusatory way such as "Excuse me, range policy requires that you point loaded firearms down-range at all times." However, if the user 301 does not comply to this statement, one or more further statements can become increasingly stern, aggressive, and the like such as "Point your weapon down-range immediately!"

In another example, one or more prompts and/or conversation statements can reference aspects of one or more previous conversation sessions, a user disciplinary history, or the like, and possible consequences based on such history with a generated conversation statement potentially being "We have already warned you three times to watch your muzzle direction, and you will be banned if you do not comply immediately!", "We have already warned you three times in the last month to watch your muzzle direction—you will lose range privileges if we need to remind you again!", "You are pointing your gun in an unsafe direction—your gun will be locked if you don't stop immediately", or the like.

In some embodiments, a prompt and/or generated conversation statement can be generated based on one or more rules (e.g., rules of a gun range 300, rules of engagement, or the like), a user skill or qualification level, one or more user authorizations, or the like, with a generated conversation statement potentially being "You are not allowed to use that type of ammunition—your gun will be locked until it is removed", "You are not allowed to use that gun—it will now be locked", "Please see a range master to qualify to use that gun—it will be locked until you are qualified", "Beginners are not allowed to shoot in that position—please take the intermediate exam to shoot in that position", or the like.

As discussed herein, smart-gun data can include audio or text data associated with a user 301 speaking (e.g., obtained by a microphone of a smart-gun 110, user device 120, range device 350, which may be converted to text in some examples, or the like). Such data can be used to generate one or more prompts to an LLM to initiate or continue a conversation with the user 301, provide a response to the user 301 and/or to determine a configuration of a smart-gun 110. For example, where a user has been alerted to a safety violation as discussed above, a user may reply "Sorry about that, I didn't realize that tracer rounds were not allowed." This can provide an opportunity to provide the user some encouragement and inform them of relevant rules. For example, a determination can be made to generate a conversation statement in reply and prompt that includes the reply statement from the user can result in a response from the LLM of "No problem. Tracer rounds and other incendiary ammunition are not allowed because they may cause a fire or damage the range. Would you like to hear about what types of ammunition are allowed and not allowed?" Accordingly, an LLM can be configured to act as a range master or other administrator and may be able to provide responses based on rules and regulations specific to the range, specific to the user, general firearm safety, general firearm information, and the like.

In another example, a smart-gun system 100 (e.g., including an LLM) can be configured to act as firearm instructor to teach basic firearm training or more advance training with a smart-gun 110. For example, an LLM can start a training session by saying "Before handling any firearm, visually and physically check to ensure it is unloaded. Open the action and inspect the chamber, magazine well, and magazine to confirm there is no ammunition present. Please go ahead and do that now."

The smart-gun system 100 can monitor the actions of the user 301 to determine whether the user has or is performing the tasks of visually and physically checking to ensure the smart-gun 110 is unloaded. Where a determination is made that the user 301 is having trouble performing one or more actions (e.g., based on smart-gun data regarding opening the action, ejecting a magazine, rotating the smart-gun 110 to inspect the chamber, magazine well, and magazine, and the like), the gun system 100 can provide instructions to assist the user 301. For example, if the user has not opened the action or seems to be having trouble, a conversation statement can be presented such as "Here is how you open the action . . . "

Where a determination has been made that the user has performed the tasks of visually and physically checking to ensure the smart-gun 110 is unloaded, the gun system 100 can present a conversation statement such as "Good job. Now let's load the gun . . . " Similarly, the gun system 100 can determine whether the user 301 is having trouble with this task and provide instructions and feedback on how to perform it safely and can determine when loading the gun has been performed (e.g., based on smart-gun orientation data, magazine status data, ammunition status data, safety status, and the like). Also, in various embodiments, the gun system 100 can determine whether the user 301 is practicing suitable muzzle discipline and can provide the user with warnings, feedback, and the like as discussed herein.

Where a determination is made that the smart-gun 110 has been properly loaded, the gun system 100 can present one or more conversation statements such as "Hold the handgun with a firm grip, ensuring your dominant hand wraps around the grip, while your non-dominant hand supports from below. Keep your fingers away from the trigger and outside the trigger guard until you are ready to shoot. Align the sights properly by focusing on the front sight and placing it within the notch of the rear sight. Ensure the sights are level and centered on the target. When ready to shoot, place your finger on the trigger and press it smoothly and steadily to the rear without disturbing the sight alignment. Avoid jerking or flinching, as this can affect your accuracy. Be prepared for the recoil when firing. Maintain your grip on the handgun, allowing it to recoil naturally without anticipating the shot or altering your grip."

The gun system 100 can determine whether the user 301 is having trouble with one or more such tasks or instructions and can provide instructions and feedback on how to perform one or more tasks safely and can determine when one or more tasks have been performed (e.g., based on smart-gun orientation data, trigger pressure data, firing state, and the like). Also, in various embodiments, the gun system 100 can determine whether the user 301 is practicing suitable muzzle discipline and can provide the user with warnings, feedback, and the like as discussed herein. In various embodiments, such instructions can be provided in stages as the user is determined to be progressing in tasks or responding to instructions.

Where a determination has been made that the user 301 has fired at least one round (e.g., based on firing data, ammunition status, trigger data, firing mechanism data, smart-gun configuration data, and the like), the gun system 100 can present one or more conversation statements such as "After firing, keep the firearm pointed in a safe direction and maintain trigger discipline. Visually confirm the firearm is clear and safe before holstering or setting it down." Also, in various embodiments, the gun system 100 can determine whether the user 301 has put the smart-gun 110 on safety and is practicing suitable muzzle or trigger discipline and can provide the user with warnings, feedback, and the like as discussed herein. In various embodiments, such instructions can be provided in stages as the user is determined to be progressing in tasks or responding to instructions.

In various embodiments the gun system 100 can be configured to respond to questions from the user, which can include responses based on smart-gun data. For example, if the user asks, "So how do I eject the magazine?", the gun system 100 can provide instructions and feedback on how to safely and properly release the magazine for smart-gun 110, which may be based on the specific identity of the smart-gun 110. One example response to this question can include "On your smart-Glock 19, the magazine release button is located on the left side of the grip, just behind the trigger guard. It is a rectangular-shaped button that protrudes slightly from the frame. To eject the magazine, use your dominant hand to firmly grip the handgun while keeping your trigger finger off the trigger and outside the trigger guard. With your thumb, press the magazine release button located on the left side of the grip. Apply firm and direct pressure to depress the button. As you press the magazine release button, use your non-dominant hand to grasp the bottom of the magazine firmly. With a quick and deliberate motion, simultaneously press the magazine release button and pull the magazine downward and away from the grip of the handgun."

Also, in various embodiments, the gun system 100 can determine whether the user 301 has put the smart-gun 110 on safety and is practicing suitable muzzle or trigger discipline and can provide the user with warnings, feedback, and the like as discussed herein. In various embodiments, such instructions can be provided in stages as the user is determined to be progressing in tasks or responding to instructions.

For example, where a determination has been made that the user has actuated the magazine release (e.g., based on magazine data, magazine release button data, or the like), the smart-gun system 100 can provide a response such as "After ejecting the magazine, visually and physically confirm that it has been fully ejected from the grip of the handgun. Ensure there are no obstructions preventing the magazine from fully disengaging."

In various embodiments, a smart-gun system 100 can act as a shooting coach and can interactively provide feedback, instructions, or the like, based on user actions, smart-gun data, user speech input, and the like. For example, a user can ask "Why is my accuracy so bad, it seems like I'm aiming right?" The smart-gun system 100 can be configured to analyze one or more previous and/or later shots to identify possible issues. For example, the smart-gun system 100 can identify that a user is anticipating recoil by involuntarily jerking the firearm upward and/or pulling the trigger prematurely in anticipation of the recoil (e.g., based on smart-gun orientation data, velocity data, firing data, trigger data, trigger pressure data, or the like).

Where one or both of these issues is identified in one or more shots made by the user, smart-gun system 100 can be configured to generate a prompt that may generate a response for the user 301 such as "It looks like you may be anticipating recoil. I noticed you're experiencing some upward movement or premature trigger pulls, which can affect your accuracy. Let's focus on some techniques to help you overcome this. First, I want you to focus on staying relaxed. Take a deep breath in and exhale slowly. Relax your grip on the firearm and loosen up any tension in your body. Remember, shooting should feel smooth and controlled, not tense or jerky. Let's try some dry fire practice. Without any live ammunition, I want you to focus on your trigger pull. Slowly press the trigger to the rear, paying attention to maintaining steady pressure without jerking or anticipating the shot. Practice this several times to get comfortable with the trigger control. As you aim at the target, concentrate on your sight alignment. Ensure your sights are properly aligned on the target and maintain a steady sight picture. Focus on the front sight and keep it steady throughout the trigger pull. Once you've pressed the trigger, continue to maintain your focus and sight alignment. Don't anticipate the recoil or lift the firearm prematurely. Keep your stance stable and follow through with the shot until after it's been fired."

In various embodiments, such instructions can be provided in stages as the user is determined to be progressing in tasks or responding to instructions, which can be based on relevant smart-gun data as discussed herein. Accordingly, in some embodiments, the example above can be tailored, modified or provided over time based on how a user is specifically progressing in tasks or responding to instructions or improving or not improving shooting techniques.

Accordingly, in various embodiments, a smart-gun system 100 can be configured to actively and interactively communicate with a user 301 of a smart-gun 110 based on the user speaking, based on smart-gun data, and the like. Such communications to and with a user 301 can be for various suitable purposes such as to improve safety, improve user firearm skills, improve user firearm knowledge, improve tactical skills, improve performance in a tactical situation, improve safety in a tactical situation, and the like. In various embodiments, such communications can be in any suitable synthesized voice or in any suitable persona or character such as a range master, shooting coach, drill instructor, squad leader, commander, or the like.

While some examples herein relate to a single user 301 with a single smart-gun 110, it should be clear that further embodiments can related to any suitable plurality of users 301 with each of the plurality of users 301 having one or more smart-guns 110 (see e.g., FIG. 4). Additionally, smart-gun data discussed herein can be obtained from a plurality of smart-guns 110 and can be used to determine one or more prompts that generate responses to one or more users 301 of smart-guns 110, which may or may not include the one or more smart-guns 110 that the smart-gun data was obtained from.

In various embodiments, smart-gun data obtained from a plurality of smart-guns 110 of a squad of military or law enforcement personnel can be used to determine instructions or feedback to the squad of military or law enforcement personnel. For example, smart-gun location data, orientation data, velocity data, and the like, can be used to identify the relative positions of the users 301 and where their respective smart-guns 110 are pointed and selectively provide instructions or feedback to one or more users 301 to prevent or reduce the likelihood of friendly fire events or to direct fire at enemy targets. In another example, smart-gun location data, orientation data, velocity data, and the like, can be used to identify where users 301 will likely be located in the future and where their smart-guns 110 will likely be pointed in the future and selectively provide instructions or feedback to one or more users 301 to prevent or reduce the likelihood of friendly fire events or to direct fire at enemy targets.

In some embodiments, artificial intelligence can be used to identify and predict squad movements and predict line or field of fire, which can be used to selectively provide instructions to one or more users 301 to prevent or reduce the likelihood of friendly fire events or to direct fire at enemy targets. For example, where artificial intelligence predicts that one or more members of a squad will move into a position where they will be in the line or field of fire of another squad member, then an instruction or feedback can be sent to that squad member to change or stop their movement to prevent or reduce the likelihood of an unsafe situation. In another example, where artificial intelligence predicts that another squad member will be in the line or field of fire of a given squad member, then an instruction or feedback can be sent to that squad member to change or stop their movement, or to change their muzzle direction to prevent or reduce the likelihood of an unsafe situation. In another example, artificial intelligence can predict the movement of one or more enemy targets and can determine an ideal location and/or muzzle direction of one or more squad members to most effectively engage such enemy targets and direct the position and/or muzzle direction of one or more squad members to direct the squad into an ideal position to engage the enemy targets. In some embodiments, artificial intelligence can determine an optimal configuration of various aspects of one or more smart-guns 110 for purposes of squad safety and/or engaging one or more enemy targets and provide an instruction or suggestion to implement changes in the one or more smart-guns 110. For example, such configuration changes can include rate of fire, type of ammunition, type or configuration of sight, on/off safety, suppressor configuration. In some embodiments, artificial intelligence can be used to automatically change various configurations of one or more smart-guns 110 without user or admin interaction or can be used to suggest changes to various configurations of one or more smart-guns 110 for approval or selection by a user or admin.

In some embodiments, parts of the methods 500, 600 of FIGS. 5 and 6 or other methods discussed herein can be performed at different times or at the same time. For example, some embodiments include a computer-implemented method of a smart-gun system, that includes obtaining a set of smart-gun data (e.g., directly or indirectly from a smart gun 110); determining, using artificial intelligence, one or more states of the smart-gun based at least in part on the set of smart-gun data; determining, using artificial intelligence, one or more states of the user based at least in part on the set of smart-gun data; determining a real-time safety level based at least in part on the one or more states of the smart-gun and the one or more states of the user; determining a smart-gun configuration change based at least in part on the real-time safety level, the one or more states of the smart-gun and the one or more states of the user, the smart-gun configuration change including putting the smart-gun on safety or otherwise making the smart-gun inoperable to fire; implementing the smart-gun configuration change automatically without human intervention, including by the user handling the smart-gun, the implementing the smart-gun configuration change including actuating the smart-gun to put the smart-gun on safety or otherwise making the smart-gun inoperable to fire; determining to generate a conversation statement based at least in part on the real-time safety level, the one or more states of the smart-gun and the one or more states of the user; generating, in response to the determining to generate the conversation statement, an LLM prompt based at least in part on the real-time safety level, the one or more states of the smart-gun and the one or more states of the user; submitting the LLM prompt to a remote LLM system; obtaining a conversation statement from the remote LLM system in response to the LLM prompt; and presenting the conversation statement via an interface of the smart-gun that includes at least a microphone, the conversation statement presented as a synthesized audio speaking voice having a persona or character.

In some embodiments, smart-gun orientation data can comprise data that indicates an orientation of a smart-gun 110 being handled by a user, smart-gun configuration data that indicates a one or more configurations of the smart-gun (e.g., safety on/off, firing configuration, ammunition configuration, and the like), smart-gun audio data (e.g., an audio recording from a microphone of a smart-gun), and the like.

In some embodiments, ammunition configuration can include whether or not the smart-gun is loaded with ammunition; whether or not a magazine is loaded in the smart-gun; a number of rounds of ammunition loaded in the smart-gun; a number of rounds of ammunition loaded in a magazine of the smart-gun; a number of rounds of ammunition loaded in the firing chamber of the smart-gun; type of ammunition(s) loaded; and the like. In some embodiments, a firing configuration can include trigger pressure, firing pin state, hammer state (e.g., cocked or not cocked), firing readiness (e.g., if the smart-gun 110 is able to fire if the trigger is pulled), bolt state, round in or not in the chamber, fire rate selection (e.g., semi-auto, burst, auto), loading mechanism status, casing ejection status, and the like.

In some embodiments, smart-gun orientation data can include an orientation of the smart-gun about an X-axis defined by the barrel of the smart-gun, an orientation of the smart-gun about a Y-axis that is perpendicular to the X-axis, an orientation of the smart-gun about a Z-axis that is perpendicular to the X-axis and Y-axis, a level status of X-axis (e.g., relative to the ground or gravity), an orientation of the X-axis relative to a firing line corresponding at least to whether the smart-gun is pointed toward or away from the firing line (e.g., a firing line of a gun range 300), an orientation of the X-axis relative to a firing line corresponding to an angle that the smart-gun is aligned with or pointed away from perpendicular to the firing line, and the like.

In various embodiments, a smart-gun 110 can be configured to be selectively locked and/or unlocked. For example, in some embodiments, a smart-gun 110 in a locked configuration can be inoperable to fire, whereas a smart-gun 110 in an unlocked configuration can be operable to fire. Locking and unlocking a smart-gun 110 can use any suitable mechanism to enable or disable the firing capability of the smart-gun 110. In one preferred embodiment, a solenoid can be used to enable or disable action of a firing pin of a smart-gun 110.

In further embodiments, one or more functionalities of a smart-gun 110 can be selectively locked/unlocked or enabled/disabled. For example, such functionalities can include, loading a magazine, unloading a magazine, loading a round into the chamber, movement of the slide, discharging a spent shell, movement of the trigger, actuation of one or more safety, cocking of the hammer, rotation of the cylinder, release of the cylinder, movement of the bolt assembly, functioning of a gas system, actuation of a selector switch, movement of a charging handle, use of sights, and the like.

In some embodiments, a smart-gun 110 can be permanently or semi-permanently disabled. For example, in one embodiment, one or more parts of smart-gun 110 can be selectively broken and/or deformed such that the smart-gun 110 is effectively irrevocably broken and un-reparable. Alternatively, one or more parts of smart-gun 110 can be selectively broken and/or deformed such that the smart-gun 110 can be repaired, but with considerable time, work, or difficulty. For example, such a broken part may be only available from a secure source or may only be replaceable by disassembly of the smart-gun 110.

Such locking, unlocking or disabling of the smart-gun 110 can occur based on various suitable circumstances, triggers, conditions, or the like. In some embodiments, such locking, unlocking or disabling of the smart-gun 110 can occur based on a signal (or lack of a signal) from one or more of the user device 120, smart-gun server 130 or administrator device 140. In one example, a user can use an application on the user device 120 to lock, unlock or disable the smart-gun 110 for use, which can include pushing a button on an application interface, inputting a password, use of voice recognition, fingerprint scanning, retinal scanning, or the like. In another example, the user can "tap" the smart-gun 110 with the user device 120 to lock, unlock or disable the smart-gun 110. In a further example, the user can request and obtain an unlock software token from a token authority which may include communication with one or both of the smart-gun server 130 or administrator device 140. Such authentication can include a two-factor authentication (e.g., an RSA token, or the like).

In further embodiments, the smart-gun 110 can be locked, unlocked or disabled based on time. In one example, a smart-gun 110 can be unlocked and then be automatically locked after a certain period of time has elapsed (e.g., a number of minutes, hours, days, weeks, or the like). In another example, a smart-gun 110 can be automatically locked and unlocked based on a schedule (e.g., unlocked from 5:50 pm until 7:30 am the following day and locked outside of this timeframe). Such a period of time or schedule can be set by a user via the user device 120, an administrator at the administrator device 140, the smart-gun server 130, or the like.

In still further embodiments, the smart-gun 110 can be locked, unlocked or disabled based on location. In one example, the smart-gun 110 can be locked, unlocked or disabled based on being inside or outside of defined physical boundaries, where location of the smart-gun 110 is defined by position of the smart-gun 110 and/or user device 120. Accordingly, one or both of the smart-gun 110 or user device 120 can be provisioned with suitable position sensors, which can include a Global Positioning System (GPS), or the like. Physical boundaries can include the range of a room of a building, the interior of a building, a city block, a metropolitan area, a country, or any other suitable boundary of any desirable size. Such physical boundaries can be set by a user via the user device 120, an administrator at the administrator device 140, the smart-gun server 130, or the like.

In some embodiments, the smart-gun system 100 can comprise one or more field enablement devices that are configured to lock, unlock or disable one or more smart-guns 110. In some examples, such a field enablement device can operate similar to a user device 120 as described herein, or in further embodiments, a field enablement device can lock, unlock or disable one or more smart-guns 110 in ways different from the command and control structure and communication pathways of a user device 120 as described herein.

Additionally, in some examples, such a field enablement device can override and/or act in addition to a user device 120 as described herein. For example, in some embodiments, a field enablement device can lock, unlock or disable one or more smart-guns 110 without a user device 120 or overriding a user device 120. Also, in some embodiments, the field enablement device can be configured to prevent, restrict or add one or more functionalities of a user device 120. For example, the field enablement device can prevent a user device 120 from unlocking any smart-guns 110, but the user device 120 can retain the functionality of locking or disabling smart-guns 110.

In another embodiment, a field enablement device can be configured to convert a user device 120 or smart-gun 110 into, or to have some or all functionalities of, a field enablement device. For example, a field enablement device can allow a user device 120 or smart-gun 110 to act as a second field enablement device, which in turn can enable one or more further user devices 120 or smart-guns 110 to act as a field enablement device. In another example, a field enablement device can be a master smart-gun 110 that can enable the smart-guns 110 around it.

Such configuration by a field enablement device can occur in various suitable ways, including direct communication with a user device 120 or smart-gun 110, or indirect communication via the network 150 as described herein. A field enablement device can include various suitable devices as described herein, which can be mobile mounted, portable, or the like. For example, a field enablement device can include or comprise a device such as a smart-gun 110, user device 120, smart-gun server 130, admin device 140, or the like.

In further embodiments, a smart-gun 110 can be configured to be locatable if misplaced, lost, stolen or in other situations where it is desirable to identify the location of the smart-gun 110. For example, in one embodiment, the smart-gun 110 can comprise a location device that includes a mini-SIM card, a small wireless rechargeable battery, and an antenna. The location device could be dormant until the location of the smart-gun 110 needs to be determined, and then a user (via a user device 120, administrator device 140, or the like) could ping the location device and determine its location (e.g., based on position relative to cell towers).

Similarly, such a location device could be associated with key fobs, wallets, purses, pet collars, and the like, which would allow such articles to be located if necessary. In some examples, such a location device could be embedded in various articles or can be disposed in a fob or token that can be attached or otherwise coupled with various articles.

A smart-gun 110 can be powered in various suitable ways. For example, in some embodiments, the smart-gun 110 can comprise a battery that is configured to be wirelessly charged (e.g., via inductive coupling, and the like). In some embodiments, a power source can be removably attached to the body of the smart-gun 110 or can be disposed within the smart-gun 110. In some embodiments, magazines for the smart-gun 110 can comprise a rechargeable power source, which can provide power to the smart-gun 110. In various embodiments, a power source associated with a smart-gun 110 can be configured to be recharged based on movement of a user, cycling of the smart-gun 110 during firing, and the like.

Various embodiments of a smart-gun system 100 (FIG. 1) can be used in beneficial ways to improve safety for firearm users and the public in general. In one example, law enforcement officers can carry smart-guns 110, which can be enabled before the officers start their shift. Such enablement can be performed by an officer's user device 120 and paired with the officer's smart-gun 110. In the event that the smart-gun 110 is lost or taken from the officer, the smart-gun 110 would automatically become locked if the smart-gun 110 was a distance away from the officer (e.g., one meter, or the like).

In another example, a smart-gun owner could enable a smart-gun 110 via a smartphone user device 120 and share the smart-gun 110 with others for use while the owner is present. The owner could set various suitable functionality limitations (e.g., the smart-gun 110 must be tapped by the smartphone user device 120 to eject or load a magazine) and the smart-gun 110 could be configured to automatically become locked if it moved out of range of the user device 120 (e.g., 10 meters, or the like).

In a further example, a gun range 300 (see e.g., FIG. 3) can rent or loan smart-guns 110 to patrons. Functionality of each smart-gun 110 could be customized for each user in any suitable way (e.g., the patron can shoot and load four magazines before the smart-gun 110 then becomes locked). Such customized functionality can occur automatically when the smart-gun 110 is checked out by the patron based on a patron user profile (e.g., patrons of different proficiency levels or age can have different sets of functionality permissions). Additionally, such smart-guns 110 could remain locked until checked out, and when checked out and unlocked, could be automatically locked if they were moved a certain proximity from the gun range 300 (e.g., out of range of a Wi-Fi network signal of the gun range 300).

In another example, law enforcement or military organizations could remotely control large groups of smart-guns 110 individually and/or collectively. Such control could be via any suitable network, including a satellite network, a cellular network, a Wi-Fi network, or the like. Such control could include unlocking, locking or disabling one or more smart-guns 110 or modifying the functionalities of one or more smart-guns 110.

In various examples, smart-guns 110 can be configured to be safe and/or inert when locked or disabled. In such examples, the smart-gun 110 can be safe, even while loaded, so that unintended users such as unsupervised children would be protected if they came in contact with a locked or disabled smart-gun 110. Additionally, the capability of locking or disabling smart-guns 110 can provide a deterrent for theft of such smart-guns 110 because in various embodiments, smart-guns 110 would be unusable by such unauthorized users.

As discussed herein, in one aspect an artificial intelligence system (e.g., a neural network) can be trained to identify states of smart-gun 110, states of one or more users 301 of smart-guns 110, and/or states of a plurality of users 301 of smart-guns 110; predict movements of one or more users 301 of smart-guns 110; predict movements or locations of enemy combatants; and the like. Such identified states, locations, positions or movements can be used to determine a response such as locking the smart-gun 110, initiating an auditory conversation with a user (e.g., via a Large Language Model (LLM)), presenting an alert to a user (e.g., auditory, visual or haptic), or the like.

Figure 7:
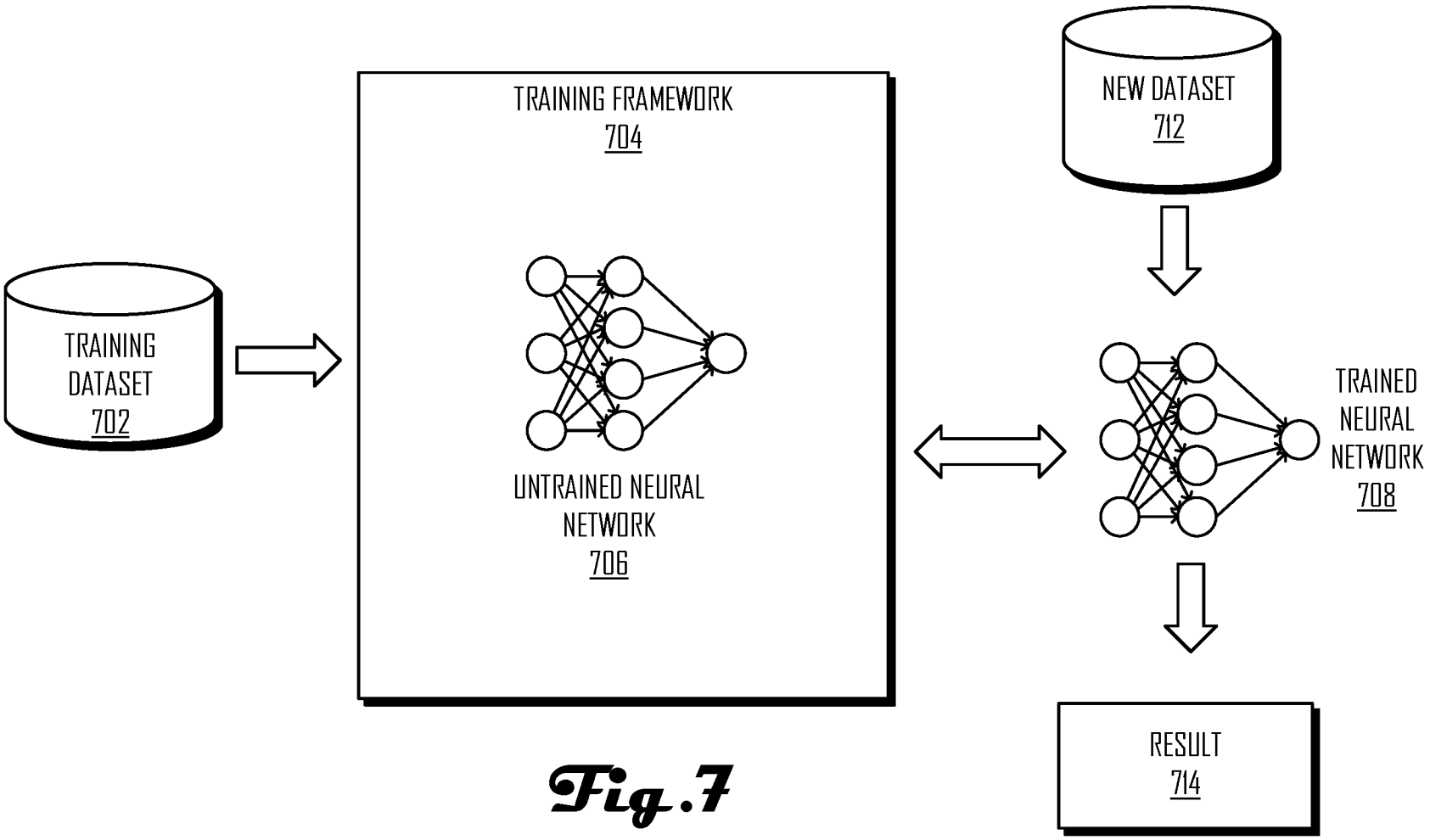
FIG. 7 illustrates training and deployment of a deep neural network, according to at least one embodiment.

FIG. 7 illustrates training and deployment of a deep neural network, according to at least one embodiment. In at least one embodiment, untrained neural network 706 is trained using a training dataset 702, which in some examples can include data obtained from a plurality of users 301, one or more respective shooter systems 305, one or more smart-guns 110, one or more user devices 120, a smart-gun server 130, an admin device 140, a range device 350, or the like. In at least one embodiment, training framework 704 is a PyTorch framework, whereas in other embodiments, training framework 704 is a TensorFlow, Boost, Caffe, Microsoft Cognitive Toolkit/CNTK, MXNet, Chainer, Keras, Deeplearning4j, or other training framework. In at least one embodiment, training framework 704 trains an untrained neural network 706 and enables it to be trained using processing resources described herein to generate a trained neural network 708. In at least one embodiment, weights may be chosen randomly or by pre-training using a deep belief network. In at least one embodiment, training may be performed in either a supervised, partially supervised, or unsupervised manner.

In at least one embodiment, untrained neural network 706 is trained using supervised learning, wherein training dataset 702 includes an input paired with a desired output for an input, or where training dataset 702 includes input having a known output and an output of untrained neural network 706 is manually graded. In at least one embodiment, untrained neural network 706 is trained in a supervised manner and processes inputs from training dataset 702 and compares resulting outputs against a set of expected or desired outputs. In at least one embodiment, errors are then propagated back through untrained neural network 706. In at least one embodiment, training framework 704 adjusts weights that control untrained neural network 706. In at least one embodiment, training framework 704 includes tools to monitor how well untrained neural network 706 is converging towards a model, such as trained neural network 708, suitable to generating correct answers, such as in result 714, based on input data such as a new dataset 712. In at least one embodiment, training framework 704 trains untrained neural network 706 repeatedly while adjust weights to refine an output of untrained neural network 706 using a loss function and adjustment algorithm, such as stochastic gradient descent. In at least one embodiment, training framework 704 trains untrained neural network 706 until untrained neural network 706 achieves a desired accuracy. In at least one embodiment, trained neural network 708 can then be deployed to implement any number of machine learning operations.

In at least one embodiment, untrained neural network 706 is trained using unsupervised learning, wherein untrained neural network 706 attempts to train itself using unlabeled data. In at least one embodiment, unsupervised learning training dataset 702 will include input data without any associated output data or "ground truth" data. In at least one embodiment, untrained neural network 706 can learn groupings within training dataset 702 and can determine how individual inputs are related to untrained dataset 702. In at least one embodiment, unsupervised training can be used to generate a self-organizing map in trained neural network 708 capable of performing operations useful in reducing dimensionality of new dataset 712. In at least one embodiment, unsupervised training can also be used to perform anomaly detection, which allows identification of data points in new dataset 712 that deviate from normal patterns of new dataset 712.

In at least one embodiment, semi-supervised learning may be used, which is a technique in which in training dataset 702 includes a mix of labeled and unlabeled data. In at least one embodiment, training framework 704 may be used to perform incremental learning, such as through transferred learning techniques. In at least one embodiment, incremental learning enables trained neural network 708 to adapt to new dataset 712 without forgetting knowledge instilled within trained neural network 708 during initial training.

In at least one embodiment, training framework 704 is a framework processed in connection with a software development toolkit such as an OpenVINO (Open Visual Inference and Neural network Optimization) toolkit. In at least one embodiment, an OpenVINO toolkit is a toolkit such as those developed by Intel Corporation of Santa Clara, CA. In at least one embodiment, OpenVINO comprises logic or uses logic to perform operations described herein. In at least one embodiment, an SoC, integrated circuit, or processor uses OpenVINO to perform operations described herein.

In at least one embodiment, OpenVINO is a toolkit for facilitating development of applications, specifically neural network applications, for various tasks and operations, such as human vision emulation, speech recognition, natural language processing, recommendation systems, and/or variations thereof. In at least one embodiment, OpenVINO supports neural networks such as convolutional neural networks (CNNs), recurrent and/or attention-based neural networks, and/or various other neural network models. In at least one embodiment, OpenVINO supports various software libraries such as OpenCV, OpenCL, and/or variations thereof.

In at least one embodiment, OpenVINO supports neural network models for various tasks and operations, such as classification, segmentation, object detection, face recognition, speech recognition, pose estimation (e.g., humans and/or objects), monocular depth estimation, image inpainting, style transfer, action recognition, colorization, and/or variations thereof. In at least one embodiment, OpenVINO supports neural network models for various tasks and operations, such as to identify states of smart-gun 110 and/or states of one or more users 301 of smart-guns 110, states of a plurality of users 301 of smart-guns 110, predict movements of one or more users 301 of smart-guns 110, predict movements or locations of enemy combatants, and the like.

In at least one embodiment, OpenVINO comprises one or more software tools and/or modules for model optimization, also referred to as a model optimizer. In at least one embodiment, a model optimizer is a command line tool that facilitates transitions between training and deployment of neural network models. In at least one embodiment, a model optimizer optimizes neural network models for execution on various devices and/or processing units, such as a GPU, CPU, PPU, GPGPU, and/or variations thereof. In at least one embodiment, a model optimizer generates an internal representation of a model, and optimizes said model to generate an intermediate representation. In at least one embodiment, a model optimizer reduces a number of layers of a model. In at least one embodiment, a model optimizer removes layers of a model that are utilized for training. In at least one embodiment, a model optimizer performs various neural network operations, such as modifying inputs to a model (e.g., resizing inputs to a model), modifying a size of inputs of a model (e.g., modifying a batch size of a model), modifying a model structure (e.g., modifying layers of a model), normalization, standardization, quantization (e.g., converting weights of a model from a first representation, such as floating point, to a second representation, such as integer), and/or variations thereof.

In at least one embodiment, OpenVINO comprises one or more software libraries for inferencing, also referred to as an inference engine. In at least one embodiment, an inference engine is a C++ library, or any suitable programming language library. In at least one embodiment, an inference engine is utilized to infer input data. In at least one embodiment, an inference engine implements various classes to infer input data and generate one or more results. In at least one embodiment, an inference engine implements one or more API functions to process an intermediate representation, set input and/or output formats, and/or execute a model on one or more devices (e.g., a smart-gun 110, user device 120, smart-gun server 130, admin device 140, range device 350, or the like).

In at least one embodiment, OpenVINO provides various abilities for heterogeneous execution of one or more neural network models. In at least one embodiment, heterogeneous execution, or heterogeneous computing, refers to one or more computing processes and/or systems that utilize one or more types of processors and/or cores. In at least one embodiment, Open VINO provides various software functions to execute a program on one or more devices (e.g., a smart-gun 110, user device 120, smart-gun server 130, admin device 140, range device 350, or the like). In at least one embodiment, OpenVINO provides various software functions to execute a program and/or portions of a program on different devices (e.g., a smart-gun 110, user device 120, smart-gun server 130, admin device 140, range device 350, or the like). In at least one embodiment, OpenVINO provides various software functions to, for example, run a first portion of code on a CPU and a second portion of code on a GPU and/or FPGA. In at least one embodiment, OpenVINO provides various software functions to execute one or more layers of a neural network on one or more devices (e.g., a first set of layers on a first device, such as a GPU, and a second set of layers on a second device, such as a CPU).

In at least one embodiment, OpenVINO includes various functionality similar to functionalities associated with a CUDA programming model, such as various neural network model operations associated with frameworks such as TensorFlow, PyTorch, and/or variations thereof. In at least one embodiment, one or more CUDA programming model operations are performed using OpenVINO. In at least one embodiment, various systems, methods, and/or techniques described herein are implemented using OpenVINO.

Figure 8:
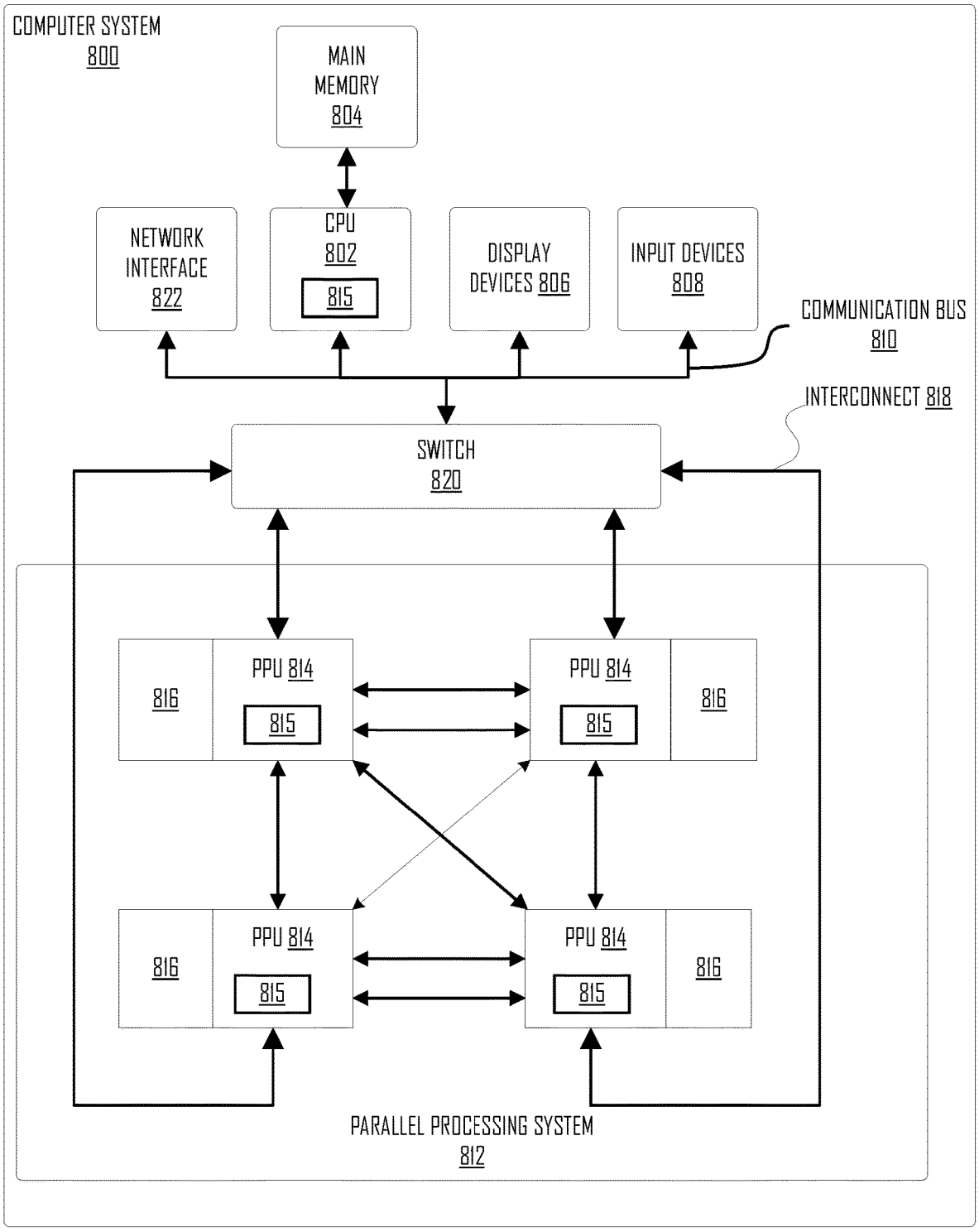
FIG. 8 illustrates a computer system according to at least one embodiment.

FIG. 8 illustrates a computer system 800, according to at least one embodiment. In at least one embodiment, computer system 800 is configured to implement various processes and methods described throughout this disclosure.

In at least one embodiment, computer system 800 comprises, without limitation, at least one central processing unit ("CPU") 802 that is connected to a communication bus 810 implemented using any suitable protocol, such as PCI ("Peripheral Component Interconnect"), peripheral component interconnect express ("PCI-Express"), AGP ("Accelerated Graphics Port"), HyperTransport, or any other bus or point-to-point communication protocol(s). In at least one embodiment, computer system 800 includes, without limitation, a main memory 804 and control logic (e.g., implemented as hardware, software, or a combination thereof) and data are stored in main memory 804, which may take form of random-access memory ("RAM"). In at least one embodiment, a network interface subsystem ("network interface") 822 provides an interface to other computing devices and networks for receiving data from and transmitting data to other systems with computer system 800.

In at least one embodiment, computer system 800, in at least one embodiment, includes, without limitation, input devices 808, a parallel processing system 812, and display devices 806 that can be implemented using a conventional cathode ray tube ("CRT"), a liquid crystal display ("LCD"), a light emitting diode ("LED") display, a plasma display, or other suitable display technologies. In at least one embodiment, user input is received from input devices 808 such as keyboard, mouse, touchpad, microphone, etc. In at least one embodiment, each module described herein can be situated on a single semiconductor platform to form a processing system.

Logic 815 are used to perform inferencing and/or training operations associated with one or more embodiments. In at least one embodiment, logic 815 may be used in computer system 800 for inferencing or predicting operations based, at least in part, on weight parameters calculated using neural network training operations, neural network functions and/or architectures, or neural network use cases described herein.

In at least one embodiment, at least one component shown or described with respect to FIG. 8 is used to implement techniques and/or functions described in connection with FIGS. 1-6. In at least one embodiment, computer system 800 performs one or more operations such as classification, segmentation, object detection, face recognition, speech recognition, pose estimation (e.g., humans and/or objects), monocular depth estimation, image inpainting, style transfer, action recognition, identifying states of smart-gun 110 and/or states of one or more users 301 of smart-guns 110, states of a plurality of users 301 of smart-guns 110, predicting movements of one or more users 301 of smart-guns 110, predicting movements or locations of enemy combatants, and the like.

In at least one embodiment, a single semiconductor platform may refer to a sole unitary semiconductor-based integrated circuit or chip. In at least one embodiment, multi-chip modules may be used with increased connectivity which simulate on-chip operation, and make substantial improvements over utilizing a conventional central processing unit ("CPU") and bus implementation. In at least one embodiment, various modules may also be situated separately or in various combinations of semiconductor platforms per desires of user.

In at least one embodiment, referring back to FIG. 8, computer programs in form of machine-readable executable code or computer control logic algorithms are stored in main memory 804 and/or secondary storage. Computer programs, if executed by one or more processors, enable system 800 to perform various functions in accordance with at least one embodiment. In at least one embodiment, memory 804, storage, and/or any other storage are possible examples of computer-readable media. In at least one embodiment, secondary storage may refer to any suitable storage device or system such as a hard disk drive and/or a removable storage drive, representing a floppy disk drive, a magnetic tape drive, a compact disk drive, digital versatile disk ("DVD") drive, recording device, universal serial bus ("USB") flash memory, etc. In at least one embodiment, architecture and/or functionality of various previous figures are implemented in context of CPU 802, parallel processing system 812, an integrated circuit capable of at least a portion of capabilities of both CPU 802, parallel processing system 812, a chipset (e.g., a group of integrated circuits designed to work and sold as a unit for performing related functions, etc.), and/or any suitable combination of integrated circuit(s).

In at least one embodiment, architecture and/or functionality of various previous figures are implemented in context of a general computer system, a circuit board system, a game console system dedicated for entertainment purposes, an application-specific system, and more. In at least one embodiment, computer system 800 may take form of a desktop computer, a laptop computer, a tablet computer, servers, supercomputers, a smart-phone (e.g., a wireless, hand-held device), personal digital assistant ("PDA"), a digital camera, a vehicle, a head mounted display, a hand-held electronic device, a mobile phone device, a television, workstation, game consoles, embedded system, and/or any other type of logic. In at least one embodiment, a computer system 800 comprises or refers to various suitable devices such as a smart-gun 110, user device 120, smart-gun server 130, admin device 140, range device 350, or the like.

In at least one embodiment, parallel processing system 812 includes, without limitation, a plurality of parallel processing units ("PPUs") 814 and associated memories 816. In at least one embodiment, PPUs 814 are connected to a host processor or other peripheral devices via an interconnect 818 and a switch 820 or multiplexer. In at least one embodiment, parallel processing system 812 distributes computational tasks across PPUs 814 which can be parallelizable—for example, as part of distribution of computational tasks across multiple graphics processing unit ("GPU") thread blocks. In at least one embodiment, memory is shared and accessible (e.g., for read and/or write access) across some or all of PPUs 814, although such shared memory may incur performance penalties relative to use of local memory and registers resident to a PPU 814. In at least one embodiment, operation of PPUs 814 is synchronized through use of a command such as _syncthreads( ) wherein all threads in a block (e.g., executed across multiple PPUs 814) to reach a certain point of execution of code before proceeding.

Figure 9:
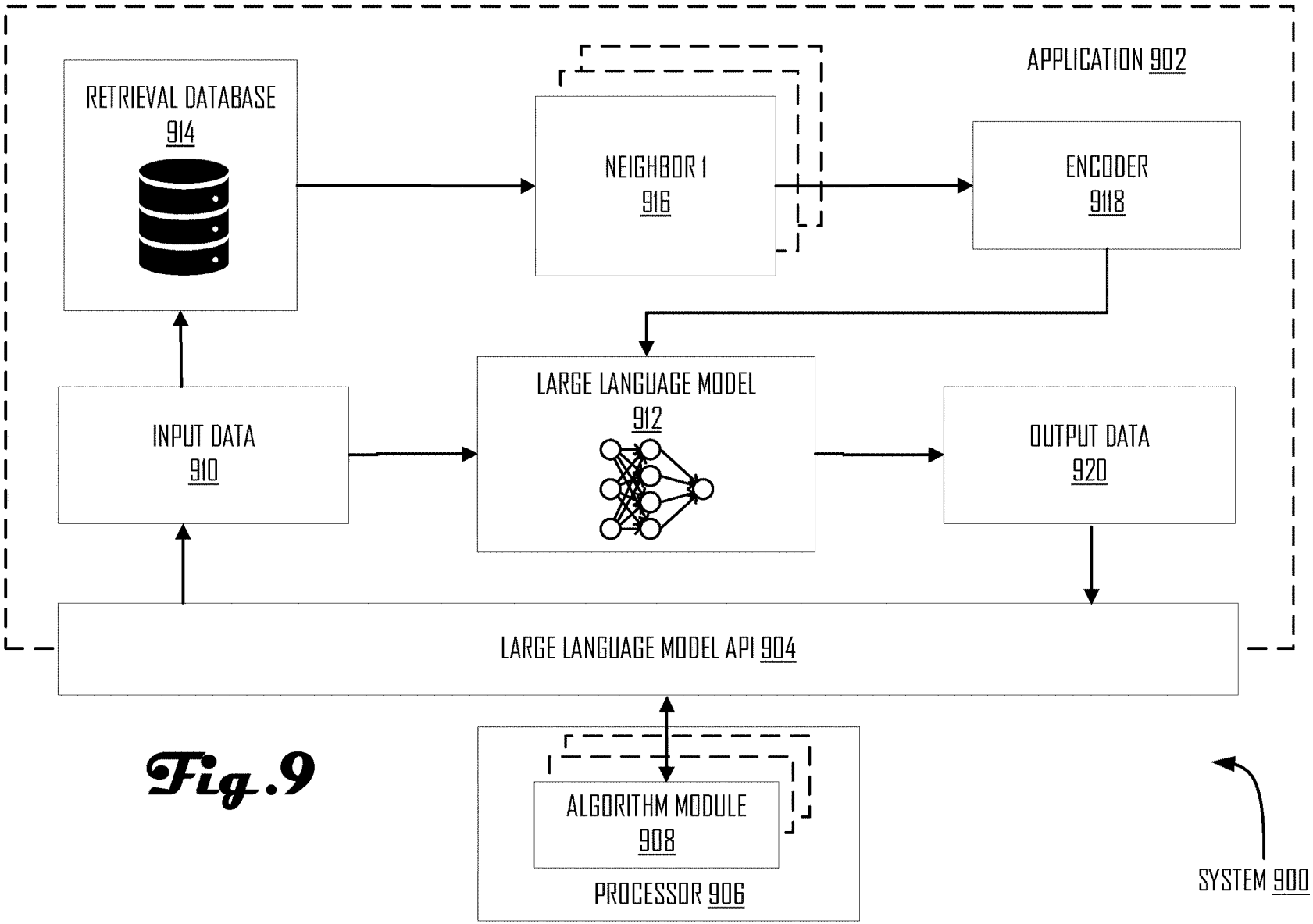
FIG. 9 is a system diagram illustrating a system for interfacing with an application to process data, according to at least one embodiment.

FIG. 9 is a system diagram illustrating system 900 for interfacing with an application 902 to process data, according to at least one embodiment. In at least one embodiment, application 902 uses large language model (LLM) 912 to generate output data 920 based, at least in part, on input data 910. In at least one embodiment, input data 910 is a text prompt. In at least one embodiment, input data 910 includes unstructured text. In at least one embodiment, input data 910 includes a sequence of tokens. In at least one embodiment, a token is a portion of input data. In at least one embodiment, a token is a word. In at least one embodiment, a token is a character. In at least one embodiment, a token is a subword. In at least one embodiment, input data 910 is formatted in Chat Markup Language (ChatML). In at least one embodiment, input data 910 is an image. In at least one embodiment, input data 910 is one or more video frames. In at least one embodiment, input data 910 is any other expressive medium.

In at least one embodiment, large language model 912 comprises a deep neural network (see e.g., FIG. 7). In at least one embodiment, a deep neural network is a neural network with two or more layers. In at least one embodiment, large language model 912 comprises a transformer model. In at least one embodiment, large language model 912 comprises a neural network configured to perform natural language processing. In at least one embodiment, large language model 912 is configured to process one or more sequences of data. In at least one embodiment, large language model 912 is configured to process text. In at least one embodiment, weights and biases of a large language model 912 are configured to process text. In at least one embodiment, large language model 912 is configured to determine patterns in data to perform one or more natural language processing tasks. In at least one embodiment, a natural language processing task comprises text generation. In at least one embodiment, a natural language processing task comprises question answering. In at least one embodiment, performing a natural language processing task results in output data 920.

In at least one embodiment, a processor uses input data 910 to query retrieval database 914. In at least one embodiment, retrieval database 914 is a key-value store. In at least one embodiment, retrieval database 914 is a corpus used to train large language model 912. In at least one embodiment, a processor uses retrieval database 914 to provide large language model 912 with updated information. In at least one embodiment, retrieval database 914 comprises data from an internet source. In at least one embodiment, large language model 912 does not use retrieval database 914 to perform inferencing.

In at least one embodiment, an encoder encodes input data 910 into one or more feature vectors. In at least one embodiment, an encoder encodes input data 910 into a sentence embedding vector. In at least one embodiment, a processor uses said sentencing embedding vector to perform a nearest neighbor search to generate one or more neighbors 916. In at least one embodiment, one or more neighbors 916 is value in retrieval database 914 corresponding to a key comprising input data 910. In at least one embodiment, one or more neighbors 916 comprise text data. In at least one embodiment, encoder 918 encodes one or more neighbors 916. In at least one embodiment, encoder 918 encodes one or more neighbors 916 into a text embedding vector. In at least one embodiment, encoder 918 encodes one or more neighbors 916 into a sentence embedding vector. In at least one embodiment, large language model 916 uses input data 910 and data generated by encoder 918 to generate output data 920. In at least one embodiment, processor 906 interfaces with application 902 using large language model (LLM) application programming interface(s) (API(s)) 904. In at least one embodiment, processor 906 accesses large language model 916 using large language model (LLM) application programming interface(s) (API(s)) 904.

In at least one embodiment, output data 920 comprise computer instructions. In at least one embodiment, output data 920 comprise instructions written in CUDA programming language. In at least one embodiment, output data 920 comprise instructions to be performed by processor 906. In at least one embodiment, output data 920 comprise instructions to control execution of one or more algorithm modules 908. In at least one embodiment, one or more algorithm modules 908 comprise, for example, one or more neural networks to perform pattern recognition. In at least one embodiment, one or more algorithm modules 908 comprise, for example, one or more neural networks to perform frame generation. In at least one embodiment, one or more algorithm modules 908 comprise, for example, one or more neural networks to generate a drive path. In at least one embodiment, one or more algorithm modules 908 comprise, for example, one or more neural networks to generate a 5G signal. In at least one embodiment, processor 906 interfaces with application 902 using large language model (LLM) application programming interface(s) (API(s)) 904. In at least one embodiment, processor 906 may use one or more parallel computing platforms and/or programming models (e.g., NVIDIA's CUDA model).

In at least one embodiment, aspects of systems and techniques described herein in relation to FIG. 9 are incorporated into aspects of preceding figure(s). For example, in at least one embodiment, an apparatus, device or system depicted in preceding figure(s) includes processor 906.

For example, in at least one embodiment, system 900 uses ChatGPT to write CUDA code. For example, in at least one embodiment, system 900 uses ChatGPT to train an object classification neural network. For example, in at least one embodiment, system 900 uses ChatGPT and a neural network to identify a driving path. For example, in at least one embodiment, system 900 uses ChatGPT and a neural network to generate a 5G signal.

In at least one embodiment, one or more techniques described herein utilize a oneAPI programming model. In at least one embodiment, a oneAPI programming model refers to a programming model for interacting with various compute accelerator architectures. In at least one embodiment, oneAPI refers to an application programming interface (API) designed to interact with various compute accelerator architectures. In at least one embodiment, a oneAPI programming model utilizes a DPC++ programming language. In at least one embodiment, a DPC++ programming language refers to a high-level language for data parallel programming productivity. In at least one embodiment, a DPC++ programming language is based at least in part on C and/or C++ programming languages. In at least one embodiment, a oneAPI programming model is a programming model such as those developed by Intel Corporation of Santa Clara, CA.

In at least one embodiment, oneAPI and/or oneAPI programming model is utilized to interact with various accelerator, GPU, processor, and/or variations thereof, architectures. In at least one embodiment, oneAPI includes a set of libraries that implement various functionalities. In at least one embodiment, oneAPI includes at least a oneAPI DPC++ library, a oneAPI math kernel library, a oneAPI data analytics library, a oneAPI deep neural network library, a oneAPI collective communications library, a oneAPI threading building blocks library, a oneAPI video processing library, and/or variations thereof.

In at least one embodiment, a oneAPI DPC++ library, also referred to as oneDPL, is a library that implements algorithms and functions to accelerate DPC++ kernel programming. In at least one embodiment, oneDPL implements one or more standard template library (STL) functions. In at least one embodiment, oneDPL implements one or more parallel STL functions. In at least one embodiment, oneDPL provides a set of library classes and functions such as parallel algorithms, iterators, function object classes, range-based API, and/or variations thereof. In at least one embodiment, oneDPL implements one or more classes and/or functions of a C++ standard library. In at least one embodiment, oneDPL implements one or more random number generator functions.

In at least one embodiment, a oneAPI math kernel library, also referred to as oneMKL, is a library that implements various optimized and parallelized routines for various mathematical functions and/or operations. In at least one embodiment, oneMKL implements one or more basic linear algebra subprograms (BLAS) and/or linear algebra package (LAPACK) dense linear algebra routines. In at least one embodiment, oneMKL implements one or more sparse BLAS linear algebra routines. In at least one embodiment, oneMKL implements one or more random number generators (RNGs). In at least one embodiment, oneMKL implements one or more vector mathematics (VM) routines for mathematical operations on vectors. In at least one embodiment, oneMKL implements one or more Fast Fourier Transform (FFT) functions.

In at least one embodiment, a oneAPI data analytics library, also referred to as oneDAL, is a library that implements various data analysis applications and distributed computations. In at least one embodiment, oneDAL implements various algorithms for preprocessing, transformation, analysis, modeling, validation, and decision making for data analytics, in batch, online, and distributed processing modes of computation. In at least one embodiment, oneDAL implements various C++ and/or Java APIs and various connectors to one or more data sources. In at least one embodiment, oneDAL implements DPC++ API extensions to a traditional C++ interface and enables GPU usage for various algorithms.

In at least one embodiment, a oneAPI deep neural network library, also referred to as oneDNN, is a library that implements various deep learning functions. In at least one embodiment, oneDNN implements various neural network, machine learning, and deep learning functions, algorithms, and/or variations thereof.

In at least one embodiment, a oneAPI collective communications library, also referred to as oneCCL, is a library that implements various applications for deep learning and machine learning workloads. In at least one embodiment, oneCCL is built upon lower-level communication middleware, such as message passing interface (MPI) and libfabrics. In at least one embodiment, oneCCL enables a set of deep learning specific optimizations, such as prioritization, persistent operations, out of order executions, and/or variations thereof. In at least one embodiment, oneCCL implements various CPU and GPU functions.

In at least one embodiment, a oneAPI threading building blocks library, also referred to as oneTBB, is a library that implements various parallelized processes for various applications. In at least one embodiment, oneTBB is utilized for task-based, shared parallel programming on a host. In at least one embodiment, oneTBB implements generic parallel algorithms. In at least one embodiment, oneTBB implements concurrent containers. In at least one embodiment, oneTBB implements a scalable memory allocator. In at least one embodiment, oneTBB implements a work-stealing task scheduler. In at least one embodiment, oneTBB implements low-level synchronization primitives. In at least one embodiment, oneTBB is compiler-independent and usable on various processors, such as GPUs, PPUs, CPUs, and/or variations thereof.

In at least one embodiment, a oneAPI video processing library, also referred to as oneVPL, is a library that is utilized for accelerating video processing in one or more applications. In at least one embodiment, oneVPL implements various video decoding, encoding, and processing functions. In at least one embodiment, oneVPL implements various functions for media pipelines on CPUs, GPUs, and other accelerators. In at least one embodiment, one VPL implements device discovery and selection in media centric and video analytics workloads. In at least one embodiment, oneVPL implements API primitives for zero-copy buffer sharing.

In at least one embodiment, a oneAPI programming model utilizes a DPC++ programming language. In at least one embodiment, a DPC++ programming language is a programming language that includes, without limitation, functionally similar versions of CUDA mechanisms to define device code and distinguish between device code and host code. In at least one embodiment, a DPC++ programming language may include a subset of functionality of a CUDA programming language. In at least one embodiment, one or more CUDA programming model operations are performed using a oneAPI programming model using a DPC++ programming language.

In at least one embodiment, any application programming interface (API) described herein is compiled into one or more instructions, operations, or any other signal by a compiler, interpreter, or other software tool. In at least one embodiment, compilation comprises generating one or more machine-executable instructions, operations, or other signals from source code. In at least one embodiment, an API compiled into one or more instructions, operations, or other signals, when performed, causes one or more processors such as graphics processors, graphics cores, parallel processor, processor, processor core, or any other logic circuit further described herein to perform one or more computing operations.

It should be noted that, while example embodiments described herein may relate to a CUDA programming model, techniques described herein can be utilized with any suitable programming model, such HIP, oneAPI, and/or variations thereof.

Other variations are within scope and spirit of present disclosure. Thus, while disclosed techniques are susceptible to various modifications and alternative constructions, certain illustrated embodiments thereof are shown in drawings and have been described above in detail. It should be understood, however, that there is no intention to limit disclosure to specific form or forms disclosed, but on contrary, intention is to cover all modifications, alternative constructions, and equivalents falling within spirit and scope of disclosure, as defined in appended claims.

Use of terms "a" and "an" and "the" and similar referents in context of describing disclosed embodiments (especially in context of following claims) are to be construed to cover both singular and plural, unless otherwise indicated herein or clearly contradicted by context, and not as a definition of a term. Terms "comprising," "having," "including," and "containing" are to be construed as open-ended terms (meaning "including, but not limited to,") unless otherwise noted. "Connected," when unmodified and referring to physical connections, is to be construed as partly or wholly contained within, attached to, or joined together, even if there is something intervening. Recitation of ranges of values herein are merely intended to serve as a shorthand method of referring individually to each separate value falling within range, unless otherwise indicated herein and each separate value is incorporated into specification as if it were individually recited herein. In at least one embodiment, use of term "set" (e.g., "a set of items") or "subset" unless otherwise noted or contradicted by context, is to be construed as a nonempty collection comprising one or more members. Further, unless otherwise noted or contradicted by context, term "subset" of a corresponding set does not necessarily denote a proper subset of corresponding set, but subset and corresponding set may be equal.

Conjunctive language, such as phrases of form "at least one of A, B, and C," or "at least one of A, B and C," unless specifically stated otherwise or otherwise clearly contradicted by context, is otherwise understood with context as used in general to present that an item, term, etc., may be either A or B or C, or any nonempty subset of set of A and B and C. For instance, in illustrative example of a set having three members, conjunctive phrases "at least one of A, B, and C" and "at least one of A, B and C" refer to any of following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, term "plurality" indicates a state of being plural (e.g., "a plurality of items" indicates multiple items). In at least one embodiment, number of items in a plurality is at least two, but can be more when so indicated either explicitly or by context. Further, unless stated otherwise or otherwise clear from context, phrase "based on" means "based at least in part on" and not "based solely on."

Operations of processes described herein can be performed in any suitable order unless otherwise indicated herein or otherwise clearly contradicted by context. In at least one embodiment, a process such as those processes described herein (or variations and/or combinations thereof) is performed under control of one or more computer systems configured with executable instructions and is implemented as code (e.g., executable instructions, one or more computer programs or one or more applications) executing collectively on one or more processors, by hardware or combinations thereof. In at least one embodiment, code is stored on a computer-readable storage medium, for example, in form of a computer program comprising a plurality of instructions executable by one or more processors. In at least one embodiment, a computer-readable storage medium is a non-transitory computer-readable storage medium that excludes transitory signals (e.g., a propagating transient electric or electromagnetic transmission) but includes non-transitory data storage circuitry (e.g., buffers, cache, and queues) within transceivers of transitory signals. In at least one embodiment, code (e.g., executable code or source code) is stored on a set of one or more non-transitory computer-readable storage media having stored thereon executable instructions (or other memory to store executable instructions) that, when executed (i.e., as a result of being executed) by one or more processors of a computer system, cause computer system to perform operations described herein. In at least one embodiment, set of non-transitory computer-readable storage media comprises multiple non-transitory computer-readable storage media and one or more of individual non-transitory storage media of multiple non-transitory computer-readable storage media lack all of code while multiple non-transitory computer-readable storage media collectively store all of code. In at least one embodiment, executable instructions are executed such that different instructions are executed by different processors—for example, a non-transitory computer-readable storage medium store instructions and a main central processing unit ("CPU") executes some of instructions while a graphics processing unit ("GPU") executes other instructions. In at least one embodiment, different components of a computer system have separate processors and different processors execute different subsets of instructions.

In at least one embodiment, an arithmetic logic unit is a set of combinational logic circuitry that takes one or more inputs to produce a result. In at least one embodiment, an arithmetic logic unit is used by a processor to implement mathematical operation such as addition, subtraction, or multiplication. In at least one embodiment, an arithmetic logic unit is used to implement logical operations such as logical AND/OR or XOR. In at least one embodiment, an arithmetic logic unit is stateless, and made from physical switching components such as semiconductor transistors arranged to form logical gates. In at least one embodiment, an arithmetic logic unit may operate internally as a stateful logic circuit with an associated clock. In at least one embodiment, an arithmetic logic unit may be constructed as an asynchronous logic circuit with an internal state not maintained in an associated register set. In at least one embodiment, an arithmetic logic unit is used by a processor to combine operands stored in one or more registers of the processor and produce an output that can be stored by the processor in another register or a memory location.

In at least one embodiment, as a result of processing an instruction retrieved by the processor, the processor presents one or more inputs or operands to an arithmetic logic unit, causing the arithmetic logic unit to produce a result based at least in part on an instruction code provided to inputs of the arithmetic logic unit. In at least one embodiment, the instruction codes provided by the processor to the ALU are based at least in part on the instruction executed by the processor. In at least one embodiment combinational logic in the ALU processes the inputs and produces an output which is placed on a bus within the processor. In at least one embodiment, the processor selects a destination register, memory location, output device, or output storage location on the output bus so that clocking the processor causes the results produced by the ALU to be sent to the desired location.

In the scope of this application, the term arithmetic logic unit, or ALU, is used to refer to any computational logic circuit that processes operands to produce a result. For example, in the present document, the term ALU can refer to a floating point unit, a DSP, a tensor core, a shader core, a coprocessor, or a CPU.

In at least one embodiment, one or more components of systems and/or processors disclosed above can communicate with one or more CPUs, ASICs, GPUs, FPGAs, or other hardware, circuitry, or integrated circuit components that include, e.g., an upscaler or upsampler to upscale an image, an image blender or image blender component to blend, mix, or add images together, a sampler to sample an image (e.g., as part of a DSP), a neural network circuit that is configured to perform an upscaler to upscale an image (e.g., from a low resolution image to a high resolution image), or other hardware to modify or generate an image, frame, or video to adjust its resolution, size, or pixels; one or more components of systems and/or processors disclosed above can use components described in this disclosure to perform methods, operations, or instructions that generate or modify an image.

Accordingly, in at least one embodiment, computer systems are configured to implement one or more services that singly or collectively perform operations of processes described herein and such computer systems are configured with applicable hardware and/or software that enable performance of operations. Further, a computer system that implements at least one embodiment of present disclosure is a single device and, in another embodiment, is a distributed computer system comprising multiple devices that operate differently such that distributed computer system performs operations described herein and such that a single device does not perform all operations.

Use of any and all examples, or exemplary language (e.g., "such as") provided herein, is intended merely to better illuminate embodiments of disclosure and does not pose a limitation on scope of disclosure unless otherwise claimed. No language in specification should be construed as indicating any non-claimed element as essential to practice of disclosure.

All references, including publications, patent applications, and patents, cited herein are hereby incorporated by reference to same extent as if each reference were individually and specifically indicated to be incorporated by reference and were set forth in its entirety herein.

In description and claims, terms "coupled" and "connected," along with their derivatives, may be used. It should be understood that these terms may be not intended as synonyms for each other. Rather, in particular examples, "connected" or "coupled" may be used to indicate that two or more elements are in direct or indirect physical or electrical contact with each other. "Coupled" may also mean that two or more elements are not in direct contact with each other, but yet still co-operate or interact with each other.

Unless specifically stated otherwise, it may be appreciated that throughout specification terms such as "processing," "computing," "calculating," "determining," or like, refer to action and/or processes of a computer or computing system, or similar electronic computing device, that manipulate and/or transform data represented as physical, such as electronic, quantities within computing system's registers and/or memories into other data similarly represented as physical quantities within computing system's memories, registers or other such information storage, transmission or display devices.

In a similar manner, term "processor" may refer to any device or portion of a device that processes electronic data from registers and/or memory and transform that electronic data into other electronic data that may be stored in registers and/or memory. As non-limiting examples, "processor" may be a CPU or a GPU. A "computing platform" may comprise one or more processors. As used herein, "software" processes may include, for example, software and/or hardware entities that perform work over time, such as tasks, threads, and intelligent agents. Also, each process may refer to multiple processes, for carrying out instructions in sequence or in parallel, continuously or intermittently. In at least one embodiment, terms "system" and "method" are used herein interchangeably insofar as system may embody one or more methods and methods may be considered a system.

In present document, references may be made to obtaining, acquiring, receiving, or inputting analog or digital data into a subsystem, computer system, or computer-implemented machine. In at least one embodiment, process of obtaining, acquiring, receiving, or inputting analog and digital data can be accomplished in a variety of ways such as by receiving data as a parameter of a function call or a call to an application programming interface. In at least one embodiment, processes of obtaining, acquiring, receiving, or inputting analog or digital data can be accomplished by transferring data via a serial or parallel interface. In at least one embodiment, processes of obtaining, acquiring, receiving, or inputting analog or digital data can be accomplished by transferring data via a computer network from providing entity to acquiring entity. In at least one embodiment, references may also be made to providing, outputting, transmitting, sending, or presenting analog or digital data. In various examples, processes of providing, outputting, transmitting, sending, or presenting analog or digital data can be accomplished by transferring data as an input or output parameter of a function call, a parameter of an application programming interface or interprocess communication mechanism.

Although descriptions herein set forth example implementations of described techniques, other architectures may be used to implement described functionality, and are intended to be within scope of this disclosure. Furthermore, although specific distributions of responsibilities may be defined above for purposes of description, various functions and responsibilities might be distributed and divided in different ways, depending on circumstances.

Furthermore, although subject matter has been described in language specific to structural features and/or methodological acts, it is to be understood that subject matter claimed in appended claims is not necessarily limited to specific features or acts described. Rather, specific features and acts are disclosed as exemplary forms of implementing the claims.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives. Additionally, any of the actions discussed herein can be performed automatically without human or user interaction.

What is claimed is:

1. A computer-implemented method of a smart-gun system, the method comprising:

obtaining a set of smart-gun data comprising:

smart-gun orientation data that indicates an orientation of a smart-gun being handled by a user, the smart-gun including a barrel, a safety, and a firing chamber, smart-gun configuration data that indicates a plurality of configurations of the smart-gun, including safety on/off, firing configuration, and ammunition configuration, and smart-gun audio data including an audio recording from a microphone of the smart-gun, determining, using artificial intelligence, one or more states of the smart-gun based at least in part on the set of smart-gun data;

determining, using artificial intelligence, one or more states of the user based at least in part on the set of smart-gun data;

determining a real-time safety level based at least in part on the one or more states of the smart-gun and the one or more states of the user;

determining a smart-gun configuration change based at least in part on the real-time safety level, the one or more states of the smart-gun and the one or more states of the user, the smart-gun configuration change including putting the smart-gun on safety or otherwise making the smart-gun inoperable to fire;

implementing the smart-gun configuration change automatically without human intervention, including by the user handling the smart-gun, the implementing the smart-gun configuration change including actuating the smart-gun to put the smart-gun on safety or otherwise making the smart-gun inoperable to fire;

determining to generate a conversation statement based at least in part on the real-time safety level, the one or more states of the smart-gun and the one or more states of the user;

generating, in response to the determining to generate the conversation statement, an LLM prompt based at least in part on the real-time safety level, the one or more states of the smart-gun and the one or more states of the user;

submitting the LLM prompt to a remote LLM system;

obtaining a conversation statement from the remote LLM system in response to the LLM prompt; and presenting the conversation statement via an interface of the smart-gun that includes at least a microphone, the conversation statement presented as a synthesized audio speaking voice having a persona or character.

2. The computer-implemented method of claim 1, wherein the ammunition configuration includes one or more of:

whether or not the smart-gun is loaded with ammunition;

whether or not a magazine is loaded in the smart-gun;

a number of rounds of ammunition loaded in the smart-gun;

a number of rounds of ammunition loaded in a magazine of the smart-gun; and a number of rounds of ammunition loaded in the firing chamber of the smart-gun.

3. The computer-implemented method of claim 1, wherein the smart-gun orientation data that indicates an orientation of a smart-gun being handled by the user comprises one or more of:

an orientation of the smart-gun about an X-axis defined by the barrel of the smart-gun, an orientation of the smart-gun about a Y-axis that is perpendicular to the X-axis, an orientation of the smart-gun about a Z-axis that is perpendicular to the X-axis and Y-axis, a level status of X-axis, an orientation of the X-axis relative to a firing line corresponding at least to whether the smart-gun is pointed toward or away from the firing line, and an orientation of the X-axis relative to a firing line corresponding to an angle that the smart-gun is aligned with or pointed away from perpendicular to the firing line.

4. The computer-implemented method of claim 1, wherein the real-time safety level based at least in part on the one or more states of the smart-gun and the one or more states of the user includes a determination of whether safety is above or below a safety threshold.

5. A computer-implemented method of a smart-gun system, the method comprising:

obtaining a set of smart-gun data comprising:

smart-gun orientation data that indicates an orientation of a smart-gun being handled by a user, the smart-gun including a barrel, a safety, and a firing chamber, smart-gun configuration data that indicates one or more configurations of the smart-gun, and smart-gun audio data including an audio recording from a microphone, determining, using artificial intelligence, one or more states of the smart-gun based at least in part on the set of smart-gun data;

determining, using artificial intelligence, one or more states of the user based at least in part on the set of smart-gun data;

determining a real-time safety level based at least in part on the one or more states of the smart-gun and the one or more states of the user;

determining to generate a conversation statement based at least in part on the real-time safety level, the one or more states of the smart-gun and the one or more states of the user;

generating, in response to the determining to generate the conversation statement, a prompt based at least in part on the real-time safety level, the one or more states of the smart-gun and the one or more states of the user;

obtaining a conversation statement in response to the prompt; and presenting the conversation statement via an interface that includes at least a microphone, the conversation statement presented as a synthesized audio speaking voice.

6. The computer-implemented method of claim 5, further comprising:

determining a smart-gun configuration change based at least in part on the real-time safety level, the one or more states of the smart-gun and the one or more states of the user, the smart-gun configuration change including putting the smart-gun on safety or otherwise making the smart-gun inoperable to fire, and implementing the smart-gun configuration change automatically without human intervention, including by the user handling the smart-gun, the implementing the smart-gun configuration change including actuating the smart-gun to put the smart-gun on safety or otherwise making the smart-gun inoperable to fire.

7. The computer-implemented method of claim 5, wherein the prompt is an LLM prompt, and wherein the LLM prompt is submitted to a remote LLM system.

8. The computer-implemented method of claim 5, wherein the interface including the microphone is part of the smart-gun.

9. A computer-implemented method of a smart-gun system, the method comprising:

obtaining a set of smart-gun data;

determining one or more states of a smart-gun based at least in part on the set of smart-gun data;

determining one or more states of a user based at least in part on the set of smart-gun data;

determining to generate a conversation statement based at least in part on the one or more states of the smart-gun and the one or more states of the user;

generating a prompt based at least in part on the one or more states of the smart-gun and the one or more states of the user, wherein the prompt is an LLM prompt, and wherein the LLM prompt is submitted to a remote LLM system; and presenting a conversation statement generated based at least in part on the one or more states of the smart-gun and the one or more states of the user.

10. The computer-implemented method of claim 9, wherein the set of smart-gun data comprises one or more of:

smart-gun orientation data that indicates an orientation of a smart-gun, and smart-gun configuration data that indicates at least one configuration of the smart-gun.

11. The computer-implemented method of claim 9, further comprising:

determining a safety level based at least in part on the one or more states of the smart-gun and the one or more states of the user.

12. The computer-implemented method of claim 9, wherein the prompt is generated further based at least in part on a safety level.

13. The computer-implemented method of claim 9, wherein the conversation statement is obtained in response to the prompt.

14. The computer-implemented method of claim 9, further comprising:

determining a smart-gun configuration change based at least in part on the one or more states of the smart-gun and the one or more states of the user, and implementing the smart-gun configuration change automatically without human intervention.

15. The computer-implemented method of claim 14, wherein the smart-gun configuration change includes making the smart-gun inoperable to fire.

16. The computer-implemented method of claim 9, wherein the conversation statement presented as a synthesized audio speaking voice.

17. The computer-implemented method of claim 9, wherein the conversation statement is presented via a microphone that is part of the smart-gun.

* * * * *